US005934478A

United States Patent [19]

Mitsumura et al.

[11] Patent Number: 5,934,478

[45] Date of Patent: Aug. 10, 1999

[54] GAS STREAM CLASSIFIER AND PROCESS FOR PRODUCING TONER

[75] Inventors: Satoshi Mitsumura, Yokohama; Toshinobu Ohnishi, Urawa; Yoshinori Tsuji, Yokohama, all of Japan

[73] Assignee: Canon Kabushiki Kaisha, Tokyo, Japan

[21] Appl. No.: 08/685,963

[22] Filed: Jul. 22, 1996

[30] Foreign Application Priority Data

| | | | |
|---|---|---|---|
| Jul. 25, 1995 | [JP] | Japan | 7-189156 |
| Jul. 25, 1995 | [JP] | Japan | 7-189160 |
| Jul. 25, 1995 | [JP] | Japan | 7-208409 |
| Jul. 25, 1995 | [JP] | Japan | 7-208490 |

[51] Int. Cl.[6] ..... B07B 7/00; G03G 9/00

[52] U.S. Cl. ..... 209/143; 209/2; 209/146; 209/154; 430/137

[58] Field of Search ..... 209/2, 133, 136, 209/137, 139.1, 142, 143, 146, 154; 430/137

[56] References Cited

U.S. PATENT DOCUMENTS

| | | | |
|---|---|---|---|
| 4,802,977 | 2/1989 | Kanda et al. | 209/143 |
| 4,872,972 | 10/1989 | Wakabayashi et al. | 209/146 X |
| 5,111,998 | 5/1992 | Kanda et al. | 241/5 |
| 5,447,275 | 9/1995 | Goka et al. | 241/5 |

FOREIGN PATENT DOCUMENTS

| | | | |
|---|---|---|---|
| 0266778 | 3/1988 | European Pat. Off. . | |
| 0287392 | 10/1988 | European Pat. Off. . | |
| 0608902 | 8/1994 | European Pat. Off. . | |
| 0666114 | 8/1995 | European Pat. Off. . | |
| 2642884 | 3/1978 | Germany . | |
| 5-253547 | 10/1993 | Japan | 209/143 |
| 7-56388 | 3/1995 | Japan . | |

OTHER PUBLICATIONS

Patent Abstracts of Japan, vol. 96, No. 11, Nov. 1996 for JP–08–182966.

Patent Abstracts of Japan, vol. 95, No. 6, Jul. 1995 for JP–07–60194.

Okuda, S. "Classification of Ultra–fine Powder", 17th Lecture and Discussion concerning Powder Engineering, pp. 15–27 (1983).

Okuda, et al., "Application of Fluidics Principle to Fine Particle Classification", Proc. Int'l Symposium on Powder Techn. pp. 771–780 (1981).

*Primary Examiner*—Tuan N. Nguyen

*Attorney, Agent, or Firm*—Fitzpatrick, Cella, Harper & Scinto

[57] ABSTRACT

A gas stream classifier has a gas stream classifier for classifying a feed powder supplied from a feed supply nozzle, into at least a coarse powder fraction, a median powder fraction and a fine powder fraction by an inertia force acting on particles and a centrifugal force acting on a curved gas stream due to Coanda effect in a classification zone, wherein the classification zone is defined by at least a Coanda block and a plurality of classifying edges, the feed supply nozzle is attached at the top of the gas stream classifier, the Coanda block is attached on one side of the feed supply nozzle, and the feed supply nozzle has at its rear end a feed powder intake portion for supplying the feed powder, and a high-pressure air intake portion.

15 Claims, 17 Drawing Sheets

GAS STREAM CLASSIFIER AND PROCESS FOR PRODUCING TONER

BACKGROUND OF THE INVENTION

1. Field of the Invention

This invention relates to a gas stream classifier (an air classifier) for classifying a powder by utilizing Coanda effect, and a process for producing a toner for developing electrostatic images, by means of such a classifier. More particularly, the present invention relates to a gas stream classifier for classifying a powder into particles with given particle sizes while carrying the powder on gas streams and also utilizing Coanda effect and the differences in inertia force and centrifugal force according to the particle size of each particle of the powder so that a powder containing 50% by number or more of particles with a weight average particle diameter of 20 $\mu$m or smaller can be classified in a good efficiency, and also relates to a process for producing toners by the use of such a classifier.

2. Related Background Art

For classifying powders, various types of gas stream classifiers are proposed. Among them, there are classifiers making use of rotating blades and classifiers having no moving part. The classifiers having no moving part include fixed-wall centrifugal classifiers and inertial classifiers. As classifiers utilizing inertia force, Elbow Jet classifiers disclosed in Okuda S. "Classification of Ultra-fine Powder", 17th Lecture and Discussion concerning Powder Engineering at Doshisha University, pp. 22, 24 and 27 (1983) and commercially available as products by Nittetsu Kogyo, and classifiers disclosed, e.g., in Okuda, S. and Yasukuni, J., Proc. of International Symposium on Powder Technology '81, 771 (1981) have been proposed as inertial classifiers that can carry out classification of powders having small particle diameters.

In such gas stream classifiers, as shown in FIGS. 15 and 16, a feed powder is jetted into the classification zone of a classifying chamber 32 at a high velocity together with a gas stream, from a feed supply nozzle 16 having an orifice that opens to the classification zone. In the classifying chamber, the powder is separated into a coarse powder fraction, a median powder fraction and a fine powder fraction by the action of centrifugal force produced by the curved gas streams flowing along a Coanda block 26, and classified into the respective fractions through means of classifying edges 117 and 118 each having a tapered end.

In such a conventional classifier 101, however, the pulverized feed material (feed powder) is fed through the feed supply nozzle 16, where the feed powder that flows through the inside of a convergent pipe has a tendency to flow with a driving force straight-forward in parallel with the pipe wall. In the feed supply nozzle 16, the feed powder, when fed from its upper part, is roughly separated into an upper stream and a lower stream. In the upper stream, light fine powder tends to be contained in a larger quantity and, in the lower stream, heavy coarse powder tends to be contained in a larger quantity. Since particles of the respective powders flow independently of each other, they form loci which are different in dependence on the portions at which they are fed into the classifying chamber, and the coarse powder disturbs the locus of the fine powder in the upper-part stream. Hence, it is difficult to further improve classification precision, so that the classification precision may be lowered when a powder having a large quantity of coarse particles with particle diameters of 20 $\mu$m or larger is classified.

As binder resins used in toners, it is common to use resins having a low melting point, a low softening point and a low glass transition point. When a powder containing such resin is introduced into the classification zone to carry out classification, the particles may be adhered or melt-adhered to the inside of the classifier.

In recent years, as measures for energy saving in copying machines, it has become popular to use soft materials such as wax as binder resins so that toner is fixed to recording mediums such as transfer mediums by pressure, to make fixing speed higher even in the case of heat fixing, and to use binder resins with a low glass transition point or binder resins with a low softening point so that power consumption necessary for fixing can be decreased and fixing can be carried out at a low temperature.

In addition, in order to improve image quality in copying machines and printers, toner particles are made gradually finer and finer. In general, the finer the substances, the larger the force acting between particles. The same applies also to resin particles and toner particles, and the particles are more liable to agglomerate as their particle size is smaller.

Once an external force such as impact force or frictional force acts on agglomerates of such particles, the particles may be fusion bonded to the vicinities of a feed powder intake and a high-pressure air intake in the case of a material feed system shown in FIG. 17, and also melt-adhered to the inside of the classifier. In particular, the particles tend to adhere to the tips of classifying edges. Once such a phenomenon arises, the classification precision is deteriorated and the classifier is not operational in a stable state, so that it may be impossible to obtain good-quality classified powders over a long period of time.

From such viewpoints, it is sought to provide a gas stream classifier that can stably and efficiently classify fine resin powders such as, in particular, toners in a good precision.

SUMMARY OF THE INVENTION

An object of the present invention is to provide a gas stream classifier in which the above problems have been solved, and a process for producing a toner by the use of such a classifier.

Another object of the present invention is to provide a gas stream classifier that enables classification in a high precision because of accurate setting of classification points, and can efficiently produce powders having precise particle size distributions, and a process for producing a toner by the use of such a classifier.

Still another object of the present invention is to provide a gas stream classifier that may hardly cause melt-adhesion of powder particles inside the classifier, may hardly cause variations of classification points, and can carry out stable classification; and a process for producing a toner by the use of such a classifier.

A further object of the present invention is to provide a gas stream classifier that enables changes of classification points in wide ranges, and a process for producing a toner by the use of such a classifier.

A still further object of the present invention is to provide a gas stream classifier that enables changes of classification points in a short time, and a process for producing a toner by the use of such a classifier.

The present invention provides a gas stream classifier comprising a gas stream classifying means for classifying a feed powder supplied from a feed supply nozzle, into at least a coarse powder fraction, a median powder fraction and a fine powder fraction by an inertia force acting on particles and a centrifugal force acting on a curved gas stream due to Coanda effect in a classification zone, wherein:

the classification zone is defined by at least a Coanda block and a plurality of classifying edges; the feed supply nozzle is provided at the top of the gas stream classifier; the Coanda block is provided on one side of the feed supply nozzle; and the feed supply nozzle has at its rear end a feed powder intake portion for supplying the feed powder, and a high-pressure air intake portion.

The present invention also provides a process for producing a toner, comprising:

classifying colored resin particles containing at least a binder resin and a colorant, by means of a gas stream classifier utilizing Coanda effect; and producing the toner from a powder fraction thus classified;

wherein;

the gas stream classifier comprises a gas stream classifying means for classifying colored resin particles supplied from a feed supply nozzle, into at least a coarse powder fraction, a median powder fraction and a fine powder fraction by an inertia force acting on particles and a centrifugal force acting on a curved gas stream due to Coanda effect in a classification zone;

the classification zone being defined by at least a Coanda block and a plurality of classifying edges; the feed supply nozzle being provided at the top of the gas stream classifier; the Coanda block being provided on one side of the feed supply nozzle; and the feed supply nozzle having at its rear end a feed powder intake portion for supplying the colored resin particles, and a high-pressure air intake portion.

The present invention still also provides a process for producing a toner, comprising;

classifying colored resin particles containing at least a binder resin and a colorant, by means of a gas stream classifier utilizing Coanda effect; and producing the toner from a powder fraction thus classified;

wherein;

the gas stream classifier comprises a gas stream classifying means for classifying colored resin particles supplied from a feed supply nozzle, into at least a coarse powder fraction, a median powder fraction and a fine powder fraction by an inertia force acting on particles and a centrifugal force acting on a curved gas stream due to Coanda effect in a classification zone;

the classification zone being defined by at least a Coanda block, a sidewall block and a plurality of classifying edges; the feed supply nozzle being provided at the top of the gas stream classifier; the Coanda block being provided on one side of the feed supply nozzle; and the feed supply nozzle having at its rear end a feed powder intake portion for supplying the colored resin particles, and a high-pressure air intake portion; and the colored resin particles being classified under the conditions of:

$$4.5\times10^{-2}<(Qf\cdot Lm)/(Qm\cdot Lf)<16$$

$$8.2\times10^{-2}<(Qm\cdot Lg)/(Qg\cdot Lm)<40$$

$$10\ \text{m/sec}<Qg/(Lg\cdot Lw)<350\ \text{m/sec}$$

where Qg represents a coarse powder fraction suction flow rate, Qm represents a median powder fraction suction flow rate, Qf represents a fine powder fraction suction flow rate, Lg represents a coarse powder fraction suction edge width, Lm represents a median powder fraction suction edge width, Lf represents a fine powder fraction suction edge width, and Lw represents a classifier width.

DESCRIPTION OF THE PREFERRED EMBODIMENTS

The gas stream classifier of the present invention has a feed supply nozzle provided at the top of the classifier, and the feed supply nozzle has at its rear end a feed powder intake portion for supplying a feed powder and has a high-pressure air intake portion.

Preferred embodiments of the gas stream classifier of the present invention and the feed supply nozzle attached thereto will be described below with reference to the accompanying drawings.

Figure 1:
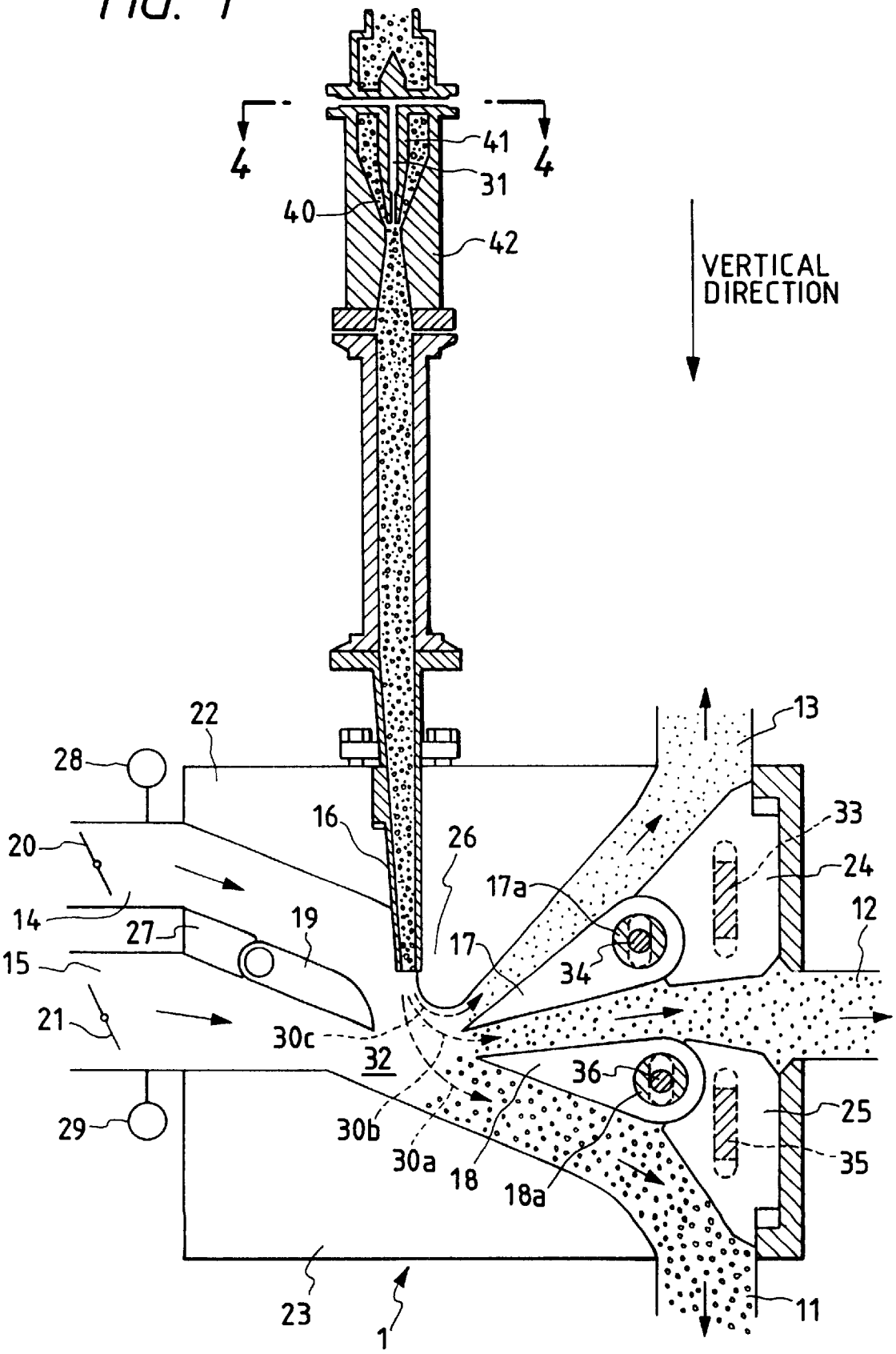
FIG. 1 is a schematic cross section of the gas stream classifier of the present invention.
Figure 2:
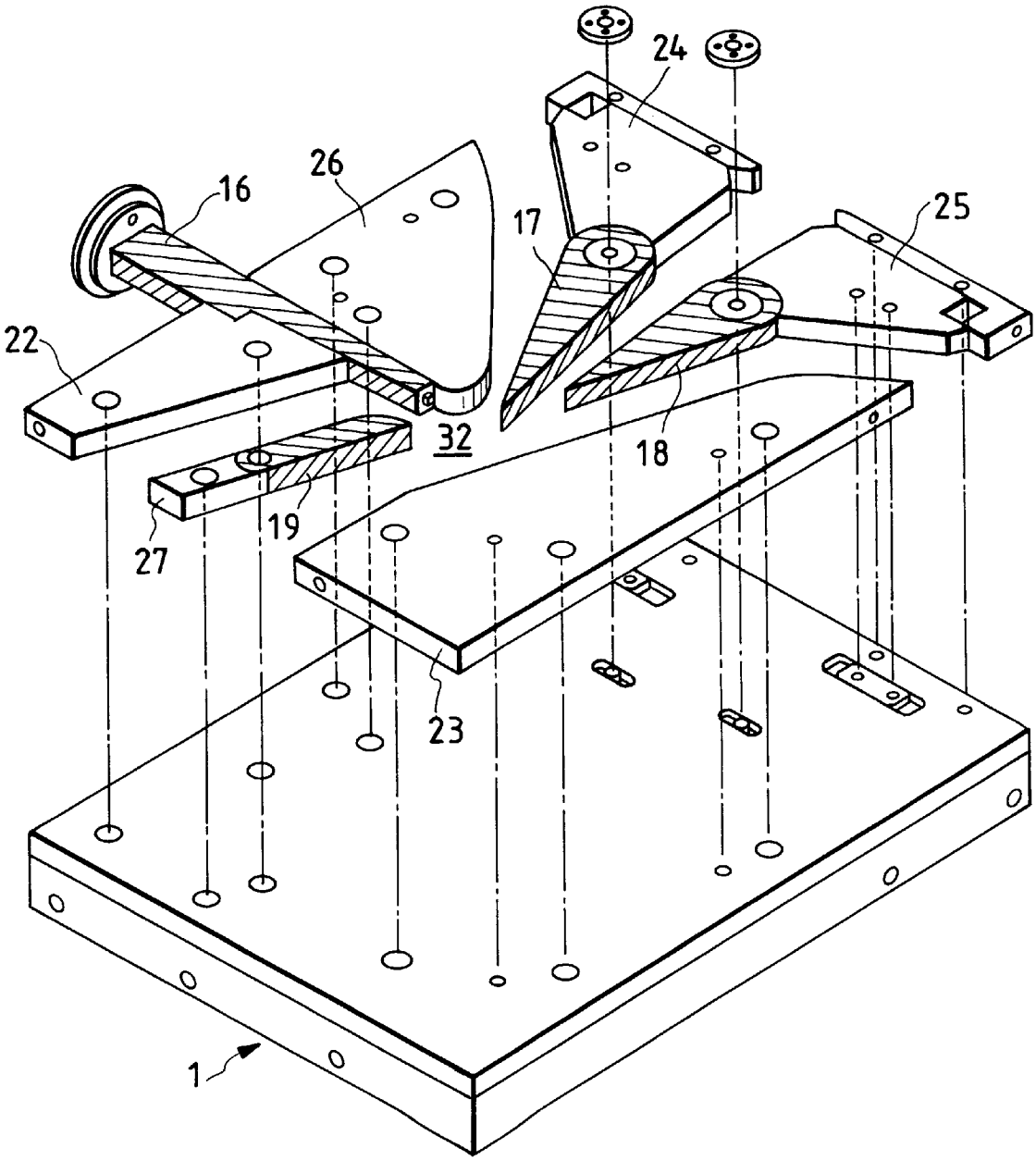
FIG. 2 is an exploded perspective view of the classifying part of the gas stream classifier shown in FIG. 1.
Figure 3:
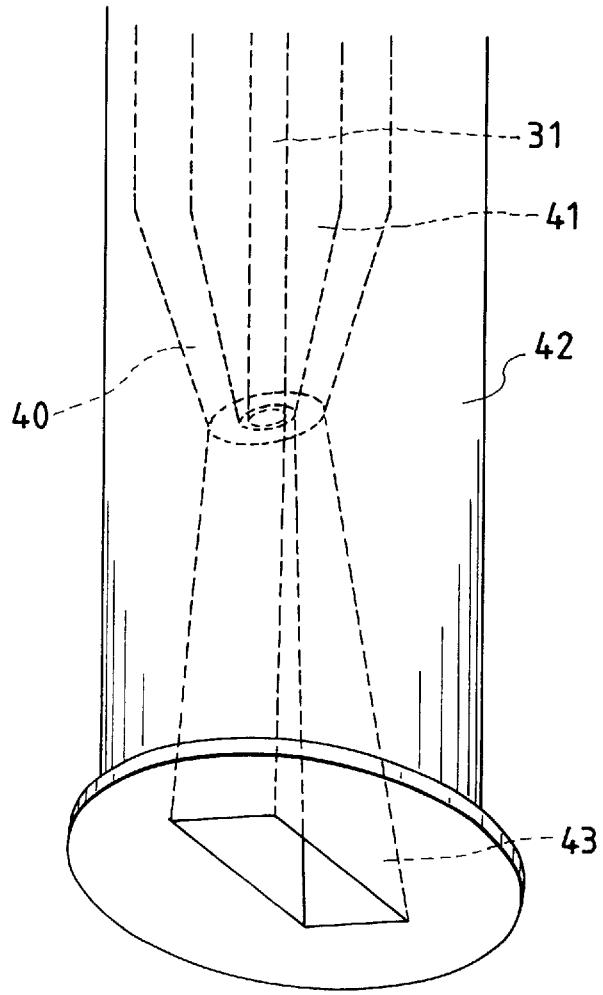
FIG. 3 illustrates a feed powder supply portion of the gas stream classifier of the present invention.
Figure 4:
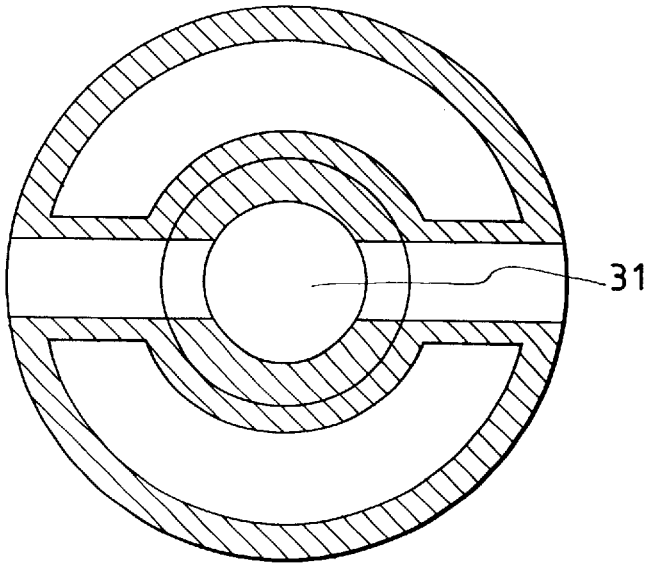
FIG. 4 is a cross section along the line 4—4 in FIG. 1.

In the gas stream classifier shown in FIGS. 1, 2 and 3, a feed supply nozzle 16 having an opening to a classifying chamber 32 serving as the classification zone is provided on the right side of a side wall 22. A Coanda block 26 is disposed on one side of the feed supply nozzle so as to form a long elliptic arc with respect to the direction of an extension of the right-side tangential line of the feed supply nozzle 16. Classifying edges 17 and 18 are provided on the right side of the classifying chamber.

The feed powder is classified into at least a coarse powder fraction, a median powder fraction and a fine powder fraction in the classification zone by an inertia force acting on particles and a centrifugal force acting on a curved gas stream due to Coanda effect. The classifying chamber 32 has a left-side block 27 provided with a knife edge-shaped air-intake edge 19 in the left-side direction of the classifying chamber 32, and further provided, on the left side of the classifying chamber 32, with air-intake pipes 14 and 15 opening into the classifying chamber 32. The air-intake pipes 14 and 15 are provided with a first gas feed control means 20 and a second gas feed control means 21, respectively, comprising, e.g. a damper, and also provided with static pressure gauges 28 and 29, respectively.

The locations of the classifying edges 17 and 18 and the air-intake edge 19 are adjusted according to the kind of the feed powder, the feed material to be classified, and also according to the desired particle size.

On the right side of the classifying chamber 32, discharge outlets 11, 12 and 13 opening into the classifying chamber are provided correspondingly to the respective fraction zones. The discharge outlets 11, 12 and 13 are connected with communicating means such as pipes, and may be respectively provided with shutter means such as valve means.

Figure 19:
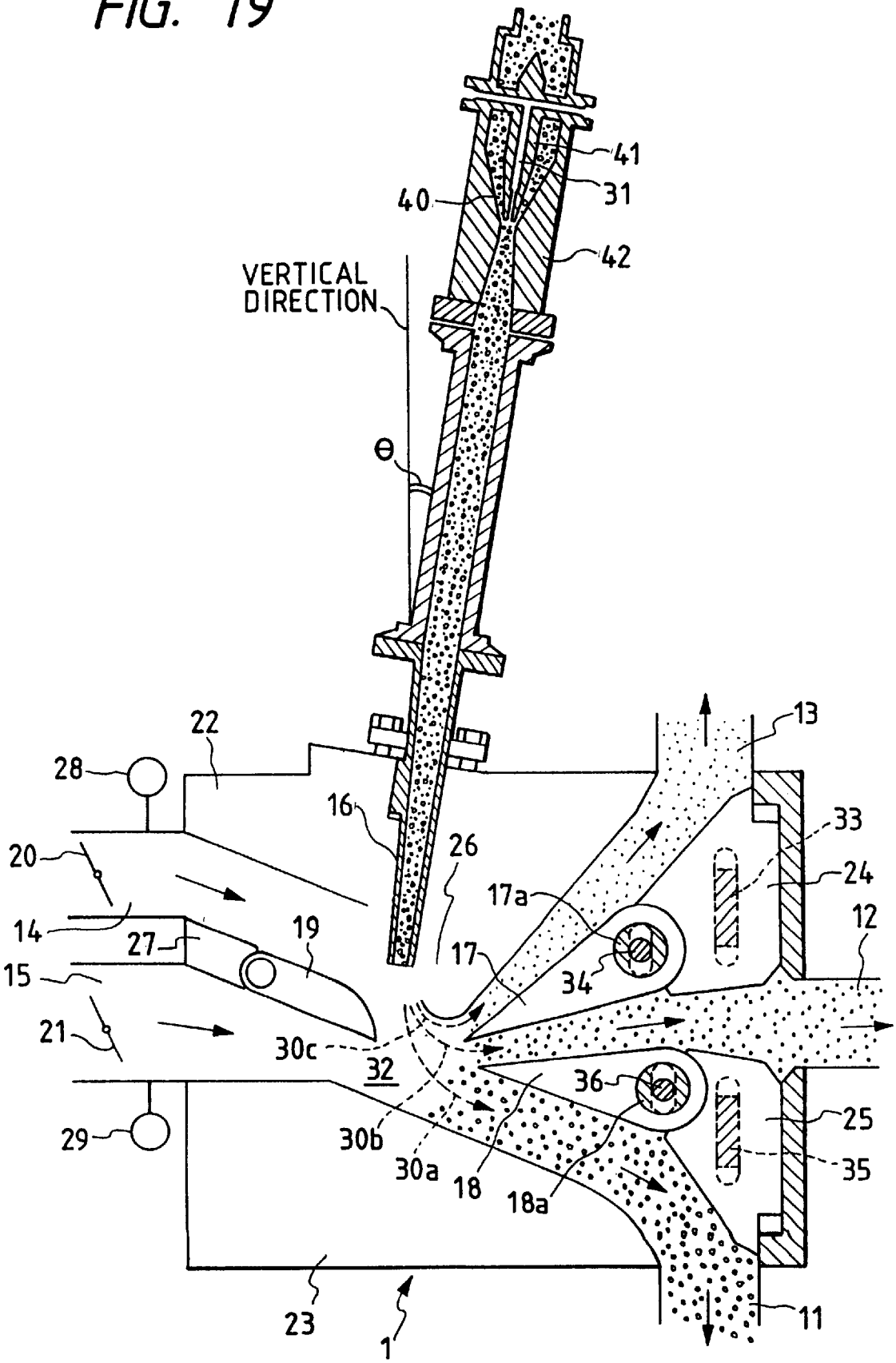
FIG. 19 illustrates a schematic cross-section of a gas stream classifier wherein the feed supply nozzle is provided at an angle of less than 45° with respect to the vertical direction.

In the gas stream classifier shown in FIG. 1, the feed supply nozzle 16, which may preferably be provided at an angle of $\theta=45°$ or smaller with respect to the vertical direction, is provided at its rear end with a high-pressure air intake pipe 41 and a feed powder intake nozzle 42. In the gas stream classifier shown in FIG. 19 the feed supply nozzle 16 is provided at an angle $\theta$ less than 45° with respect to the vertical direction. The feed powder is supplied from the top of a feed supply opening 40. The feed powder thus supplied is emitted or ejected from the lower part of the feed powder intake nozzle 42 through the periphery of the high-pressure air intake pipe 41, and is accelerated by the aid of high-pressure air so as to be well dispersed. The feed powder well dispersed can be supplied to the inside of the feed supply nozzle 16.

The principle of suction ejection of feed powder at the feed powder supply part is based on the ejector effect that occurs when the high-pressure air from the high-pressure air intake pipe 41 expands at the feed supply nozzle 16 to produce a vacuum.

The feed supply nozzle 16 comprises a rectangular pipe section and a tapered or convergent pipe section, and the ratio of the inner diameter of the rectangular pipe section to the inner diameter of the narrowest part of the convergent pipe section may be set at from 20:1 to 1:1, and preferably from 10:1 to 2:1, to give a good feed velocity.

Figure 15:
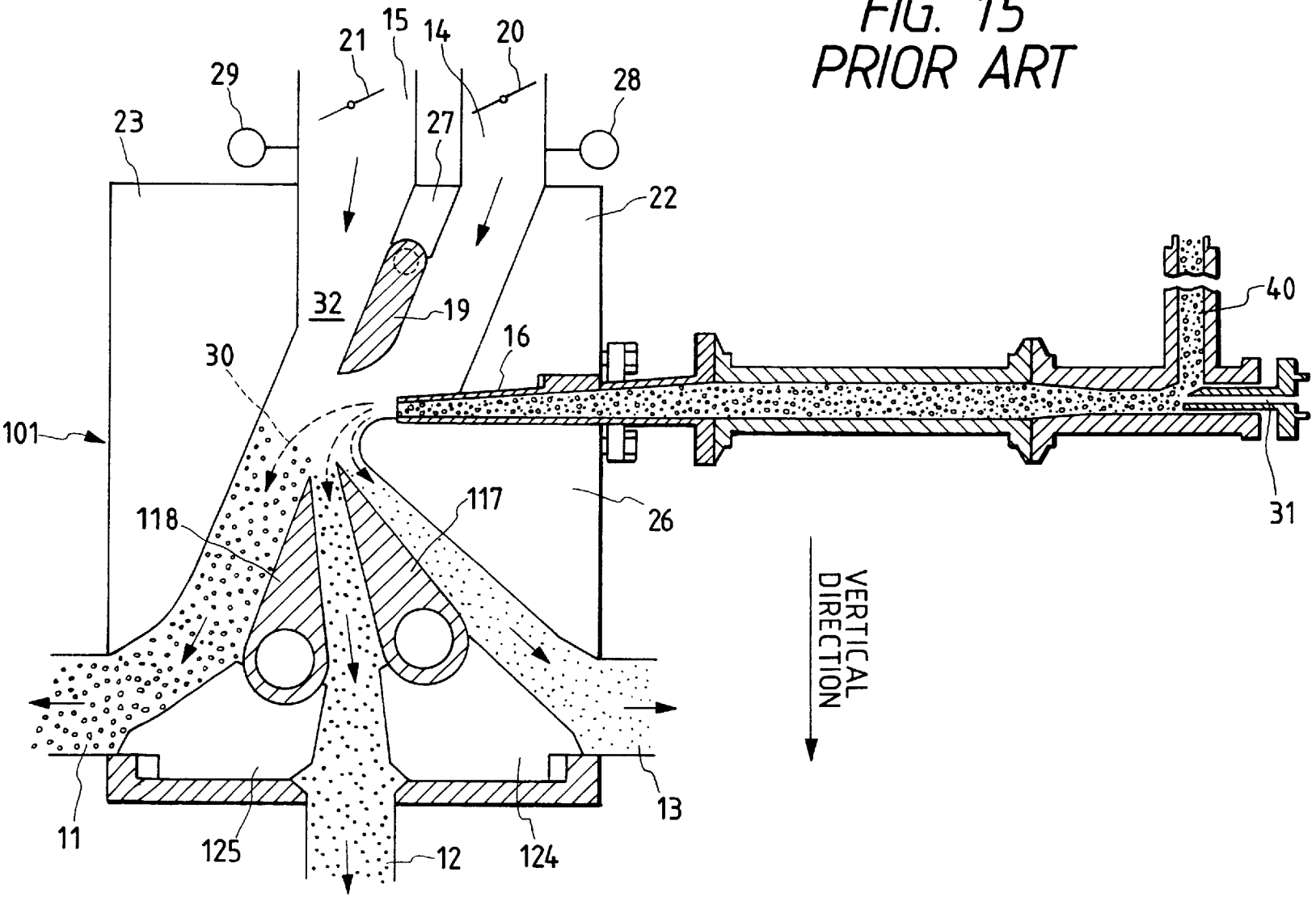
FIG. 15 PRIOR ART
FIG. 15 is a schematic cross section of a conventional gas stream classifier.

In the conventional classifier 101 as shown in FIG. 15, classifying edge blocks 124 and 125 stand stationary to the main body of the classifier, and the positions of the tips of the classifying edges 117 and 118, respectively, are adjusted, the flow rates of the gas streams for classification can be correspondingly adjusted, setting the classification points (i.e., the particles sizes at which the powder is classified) to the desired values. Also, the tip positions of the classifying edges, corresponding to the gravity and stated classification points of the powder, are detected and moved to be controlled so as to maintain the stated flow rates. Such control of only the tip positions of the classifying edges 117 and 118 tends to cause disturbance of gas streams in the vicinity of the tips of edges, depending on their angles, so that no classification may be effected in a good precision, and particles with a size which should belong to another fraction of particles, may be included into a fraction of particles which originally should have a uniform size. Also when it is desired to change the classification points, the locations of the classifying edges can not be controlled along the direction of gas streams even if the tip positions of the classifying edges are shifted to be controlled so as to restore the stated flow rates. After all, not only it takes time to adjust the classification points to the stated values but also the classification precision is deteriorated, bringing about problems to be settled. In particular, when classification is carried out to produce toners for developing electrostatic images, used in copying machines, printers and so forth, such problems may remarkably occur.

In general, toners are required to have many kinds of properties. The properties of toners are affected by starting materials used in toners, and may also be often affected by processes for producing toners. Thus, in order to meet such requirements, in the step of classification for producing toners, it is required to stably produce good-quality toners at a low cost and in a good efficiency.

To meet such requirements, in the gas stream classifier of the present invention as shown in FIG. 1, side walls 22 and 23 form part of the classifying chamber, and the classifying edges 17 and 18 divide the classification zone of the classifying chamber 32 into three sections. Classifying edge blocks 24 and 25 have classifying edges 17 and 18, respectively. The classifying edges 17 and 18 stand swing-movable around shafts 17*a* and 18*a*, respectively, and thus the tip position of each classifying edge can be changed by the swinging of the classifying edge. The respective classifying edge blocks 24 and 25 are so set up that their locations can be slided up and down. As they are slided, the corresponding knife-edge type classifying edges 17 and 18 are also slided up and down. Hence, when the form of the classification zone is changed, the classification zone can be made larger or smaller in wide ranges and also the classification points can be changed in wide ranges. At the same time, the classification points can be adjusted in a good precision without causing disturbance of gas streams around the tips of classifying edges.

The classification in the multi-division classifying zone having the above construction is operated, for example, in the following way. The inside of the classifying chamber is evacuated through at least one of the discharge outlets 11, 12 and 13. The feed powder is jetted into the classifying chamber 32 through the feed supply nozzle 16 at a flow velocity of preferably from 50 m/sec to 300 m/sec, utilizing the gas stream flowing by the aid of high-pressure air and the vacuum pressure, through the path inside the feed supply nozzle 16 opening into the classifying chamber.

Particles in the powder fed into the classifying chamber are moved to draw 30*a*, 30*b* and 30*c* by the action attributable to the Coanda effect of the Coanda block 26 and the action of gases such as air concurrently flowed in, and are classified according to the particle size and inertia force of the individual particles in such a way that larger particles (coarse particles) are classified to the lower division (i.e., the lower-side first division of the classifying edge 18), median particles are classified to the second division defined between the classifying edges 18 and 17, and smaller particles are classified to the third division on the upper side of the classifying edge 17. The larger particles, median particles and smaller particles thus separated by classification are discharged from the discharge outlets 11, 12 and 13, respectively.

In the classification of feed powder, the classification points chiefly depend on the tip positions of the classifying edges 17 and 18 with respect to the lower end of the Coanda block 26 where the feed powder is jetted out into the classifying chamber 32. The classification points are also affected by the flow rate of classification gas streams or the velocity of the powder jetted out of the feed supply nozzle 16.

In the gas stream classifier of the present invention, the feed powder is supplied from the feed powder supply opening 40. The feed powder thus supplied is emitted or ejected from the lower part of the feed powder intake nozzle 42 through the periphery of the high-pressure air intake pipe 41, and is accelerated by the aid of high-pressure air so as to be well dispersed. The feed powder is instantaneously introduced into the classifying chamber from the feed supply nozzle 16, classified there and then discharged outside the system of the classifier. It is important for the feed powder introduced into the classifying chamber, to fly with a driving force without causing the disturbance of loca of individual particles, in a state in which agglomerated powder is dispersed to primary particles, because of the head portion at which the powder is introduced from the feed supply nozzle 16 into the classifying chamber. When the feed powder is introduced from the upper part, the particles flow downward through the path of the feed supply nozzle 16. Upon the introduction of the flow of powder into the classifying chamber 32 having the Coanda block 26 on the right side of the orifice of the feed supply nozzle 16, the powder is dispersed according to the size of particles to form particle streams, without disturbance of the flying loca of particles. Thus, the classifying edges are shifted in the direction along their streamlines and then the tip positions of the classifying edges are set stationary, so that they can be set at stated classification points. When these classifying edges 17 and 18 are shifted, they are shifted concurrently with the shift of the classifying edge blocks 24 and 25, whereby the classifying edges can be shifted along the directions of streams of the particles flying along the Coanda block 26.

Figure 5:
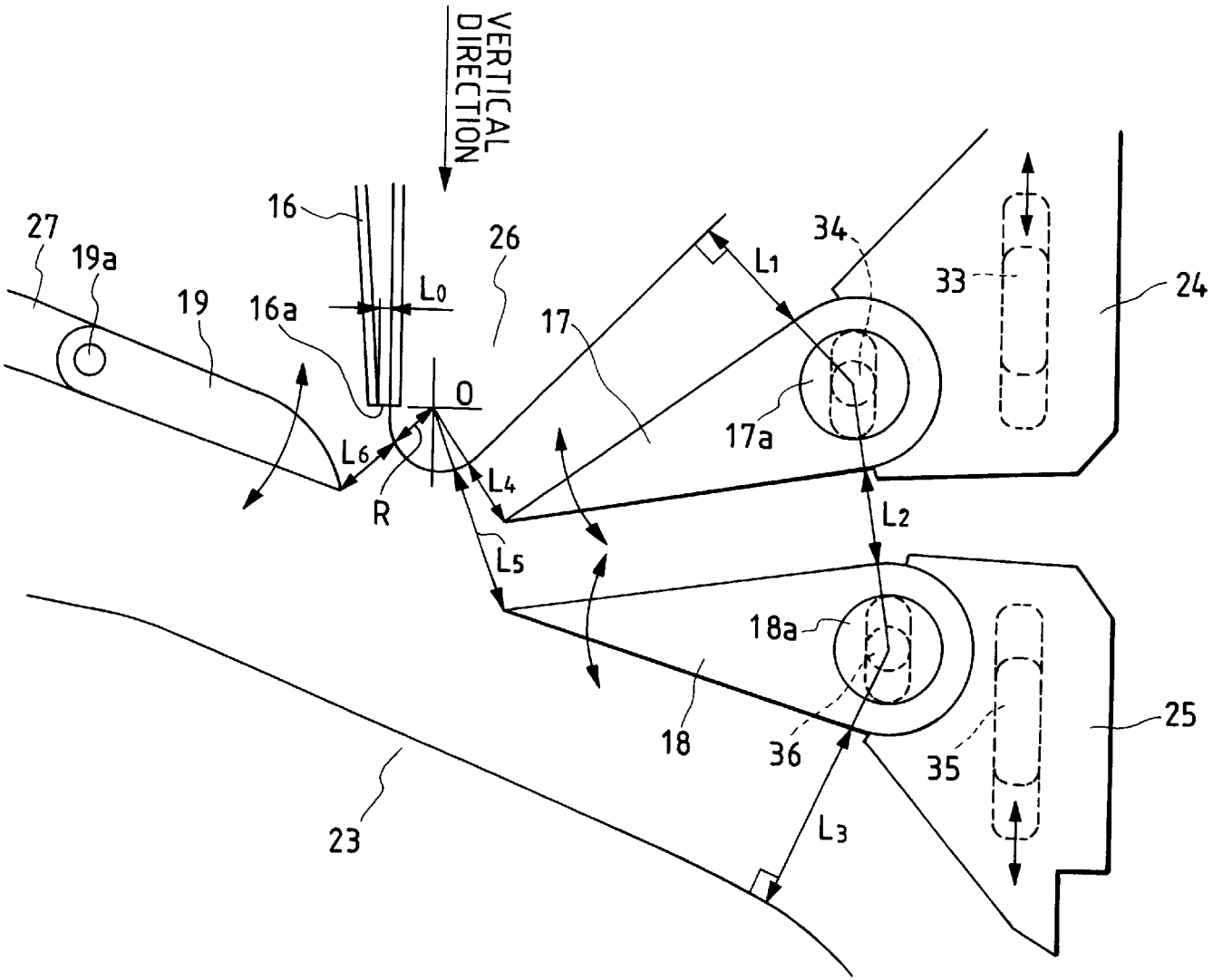
FIG. 5 illustrates the main part in FIG. 1.

This will be described more specifically with reference to FIG. 5. A position O, for example, in the Coanda block 26, which corresponds to the side position of the orifice 16*a* of the feed supply nozzle 16, is assumed as the center, where a distance $L_4$ between the tip of the classifying edge 17 and the side of the Coanda block 26 and a distance $L_1$ between the side of the classifying edge 17 and the side of the Coanda block 26 can be adjusted by shifting up and down the classifying edge block 24 along the locating (or positioning) member 33 so that the classifying edge 17 is shifted up and down along the locating member 34, and also by moving the tip of the classifying edge 17 around the shaft 17*a*.

Similarly, a distance $L_5$ between the tip of the classifying edge 18 and the sidewall of the Coanda block 26 and a distance $L_2$ between the side of the classifying edge 17 and the side of the classifying edge 18 or a distance $L_3$ between the side of the classifying edge 18 and the surface of a sidewall 23 can be adjusted by shifting up and down the classifying edge block 25 along the locating member 35 so that the classifying edge 18 is shifted up and down along the locating member 36, and also by moving the tip of the classifying edge 18 around the shaft 18*a*.

The Coanda block 26 and the classifying edges 17 and 18 are provided on a side position of the orifice 16*a* of the feed supply nozzle 16, and the classification zone of the classifying chamber is made larger as the set locations of the classifying edge block 24 and/or the classifying edge block 25 are changed. Thus, the classification points can be adjusted with ease and in wide ranges.

Hence, the disturbance of streams that may be caused by the tips of the classifying edges can be prevented, and the flying velocity of particles can be increased to more improve the dispersion of feed powder in the classification zone, by adjusting the flow rates of suction streams produced by the evacuation through discharge pipes 11*a*, 12*a* and 13*a*. Thus, not only a good classification precision can be achieved even in a high powder concentration and the yield of particles to be obtained as products can be prevented from lowering, but also a better classification precision and an improvement in the yield of products can be achieved in the like powder concentration.

A distance $L_6$ between the tip of the air-intake edge 19 and the wall surface of the Coanda block 26 can be adjusted by moving the tip of the air-intake edge 19 around the shaft 19*a*. Thus, the classification points can be further adjusted by controlling the flow rate and flow velocity of the air or gases flowing from the air-intake pipes 14 and 15.

The set distances described above are appropriately determined according to the properties of feed powders. In the case where a feed powder has a true density of from 0.3 to 1.4 g/cm$^3$, the location may preferably fulfill the condition of:

$$L_0<L_1+L_2<nL_3$$

($L_0$ is a diameter of the discharge orifice 16*a* of the feed supply nozzle; and n is a real number of 1 or more) and in the case where a feed powder has a true density higher than 1.4 g/cm$^3$:

$$L_0<L_3<L_1+L_2$$

When this condition is fulfilled, products (median powder fraction) having a sharp particle size distribution can be obtained in a good efficiency.

Figure 6:
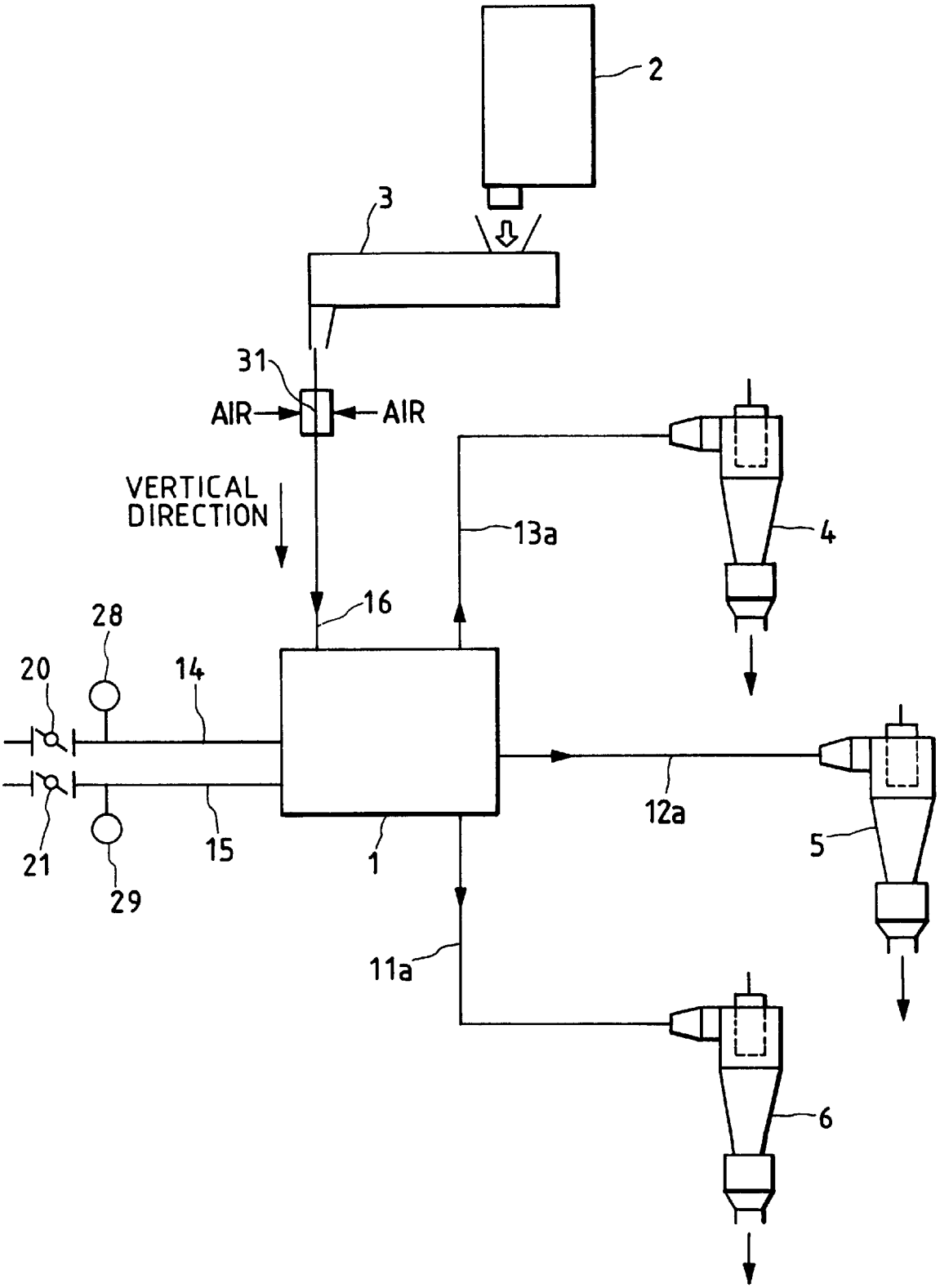
FIG. 6 illustrates an example of a classification process carried out using the gas stream classifier of the present invention.

The gas stream classifier of the present invention is usually used as a component unit of a unit system in which correlated equipments are connected through communicating means such as pipes. A preferred example of such a unit system is shown in FIG. 6. In the unit system as illustrated in FIG. 6, a three-division classifier 1 (the classifier as illustrated in FIGS. 1 and 2), a quantitative feeder 2, a vibrating feeder 3, and collecting cyclones 4, 5 and 6 are all connected through communicating means.

In this unit system, the feed powder is fed into the quantitative feeder 2 through a suitable means, and then introduced into the three-division classifier 1 from the vibrating feeder 3 through the feed supply nozzle 16. When introduced, the feed powder may be fed into the three-division classifier 1 at a flow velocity of 50 to 300 m/sec. The classifying chamber of the three-division classifier 1 is constructed usually with a size of [10 to 50 cm]×[10 to 50 cm], so that the feed powder can be instantaneously classified in 0.1 to 0.01 seconds or less, into three or more fractions of particles. Then, the feed powder is classified by the three-division classifier 1 into a fraction of larger particles (coarse particles), a fraction of median particles and a fraction of smaller particles. Thereafter, the larger particles are passed through a discharge guide pipe 11*a*, and sent to, and collected in, the collecting cyclone 6. The median particles are discharged outside the system through the discharge pipe 12*a*, and collected in the collecting cyclone 5. The smaller particles are discharged outside the system through the discharge pipe 13*a* and collected in the collecting cyclone 4. The collecting cyclones 4, 5 and 6 may also function as suction evacuation means for suction-feeding the feed powder to the classifying chamber through the feed supply nozzle 16.

The gas stream classifier of the present invention is effective especially when classifying toners or colored resin powders for toners used in image formation carried out by electrophotography. In particular, it is effective when classifying toner compositions comprising a binder resin having a low melting point, a low softening point or a low glass transition point.

Figure 16:
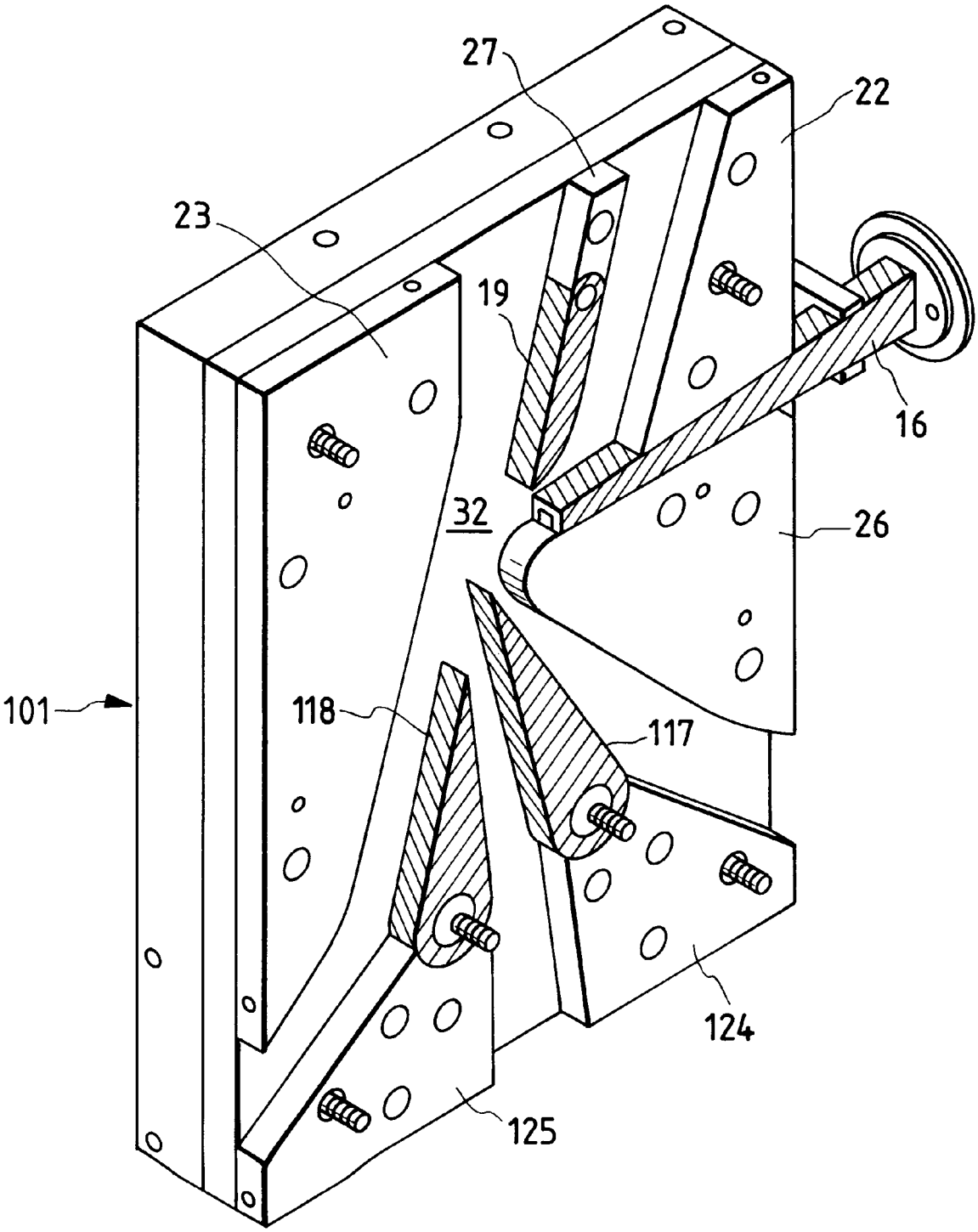
FIG. 16 PRIOR ART
FIG. 16 is a perspective view of the gas stream classifier shown in FIG. 15.
Figure 17:
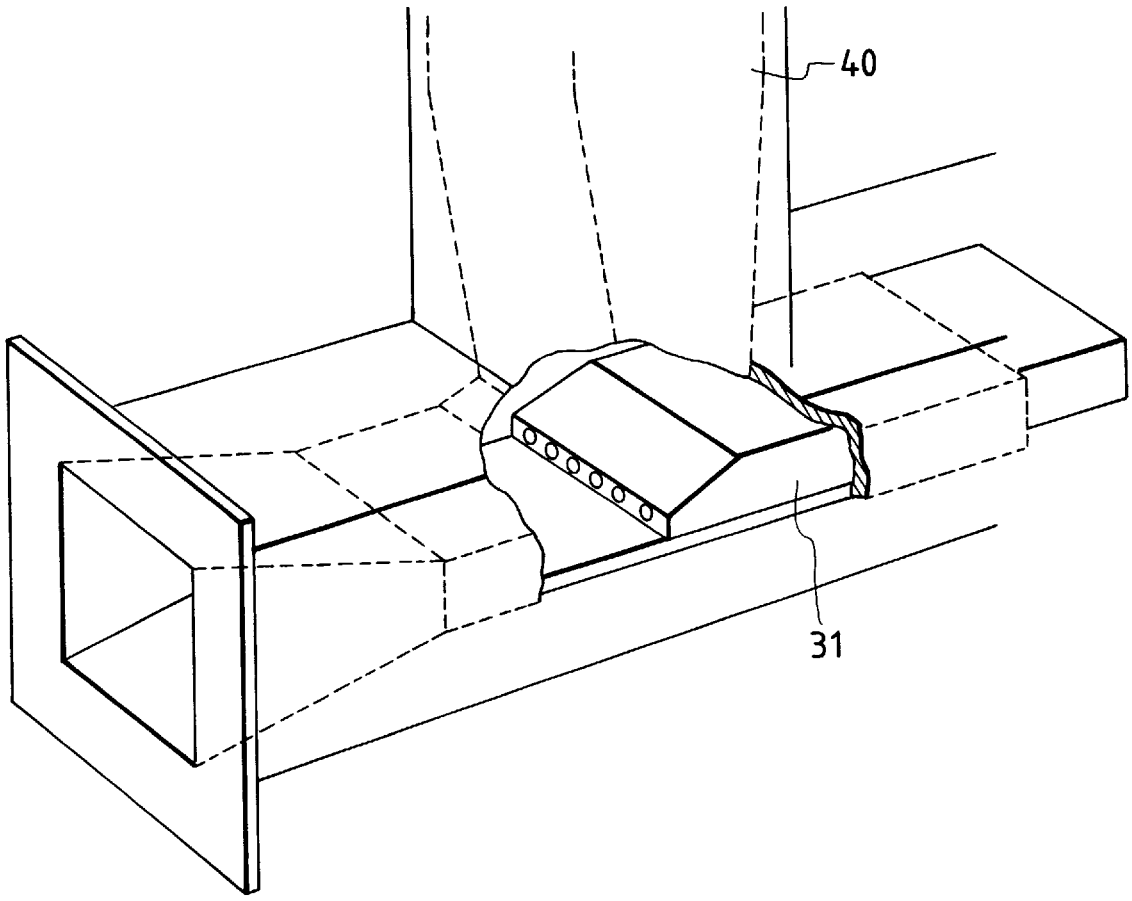
FIG. 17 PRIOR ART
FIG. 17 is a perspective view of a conventional feed supply part.

On the other hand, if powders of resin compositions for toners are fed from the feed supply opening 40 to the conventional classifier shown in FIGS. 15 and 16, particles tend to melt-adhere to a particle flow path pipes extending from the tip of an injection air intake pipe 31 shown in FIG. 17, to the feed supply nozzle 16, and also melt-adhere to the tips of classifying edges 17 and 18. Once the melt-adhesion occurs, classification points may deviate from suitable values. If flow rates are adjusted by suction evacuation, it is difficult to obtain the required particle size distribution of the powder, resulting in a decrease in classification efficiency. Moreover, the matter produced by melt adhesion may be included into the classified powder.

In the classifier of the present invention, the classifying edges 17 and 18 are shifted concurrently with the shift of the classifying edge blocks 24 and 25 so that the classifying edges are shifted along the directions of streams of the particles flying along the Coanda block 26, whereupon the flow rates of suction streams are adjusted through the discharge pipes 11*a*, 12*a* and 13*a* serving as suction evacuation means. Thus, the flying velocity of particles can be increased to more improve the powder dispersion in the classification zone, and hence the classification yield can be improved and also the particles can be prevented from adhering to the tips of classifying edges, enabling high-precision classification.

The classifier of the present invention can be more remarkably effective as the powder has smaller particle diameters, and classified products having a sharp particle size distribution can be obtained especially when powders with a weight average particle diameter of 10 $\mu$m or smaller are classified. Classified products having a sharp particle size distribution can also be obtained well when powders with a weight average particle diameter of 6 $\mu$m or smaller are classified.

In the classifier of the present invention, the direction of each classifying edge and the edge tip position may be changed by using a drive means such as a stepping motor as a shifting means and the edge tip position may be detected by means of a detecting means such as a potentiometer. A control device for controlling these may control the tip positions of classifying edges and also the control of flow rates may be automated. This is more preferable since the desired classification points can be obtained in a short time and more accurately.

Another preferred gas stream classifier will be described below with reference to FIGS. 7, 8 and 9.

A side wall 22 and a side-wall block 23*a* form part of the classifying chamber, and classifying edge blocks 24 and 25 have classifying edges 17 and 18, respectively. The side-wall block 23*a* is so set that its set location can be slided up and down. The classifying edges 17 and 18 stand swing-movable around shafts 17*a* and 18*a*, respectively, and thus the tip position of each classifying edge can be changed by swinging the classifying edge. The respective classifying edge blocks 24 and 25 are so set that their locations can be slided up and down. As they are slided, the corresponding knife-edge type classifying edges 17 and 18 are also slided up and down. Hence, the form of the classification zone and the classification points can be changed in wide ranges.

Figure 7:
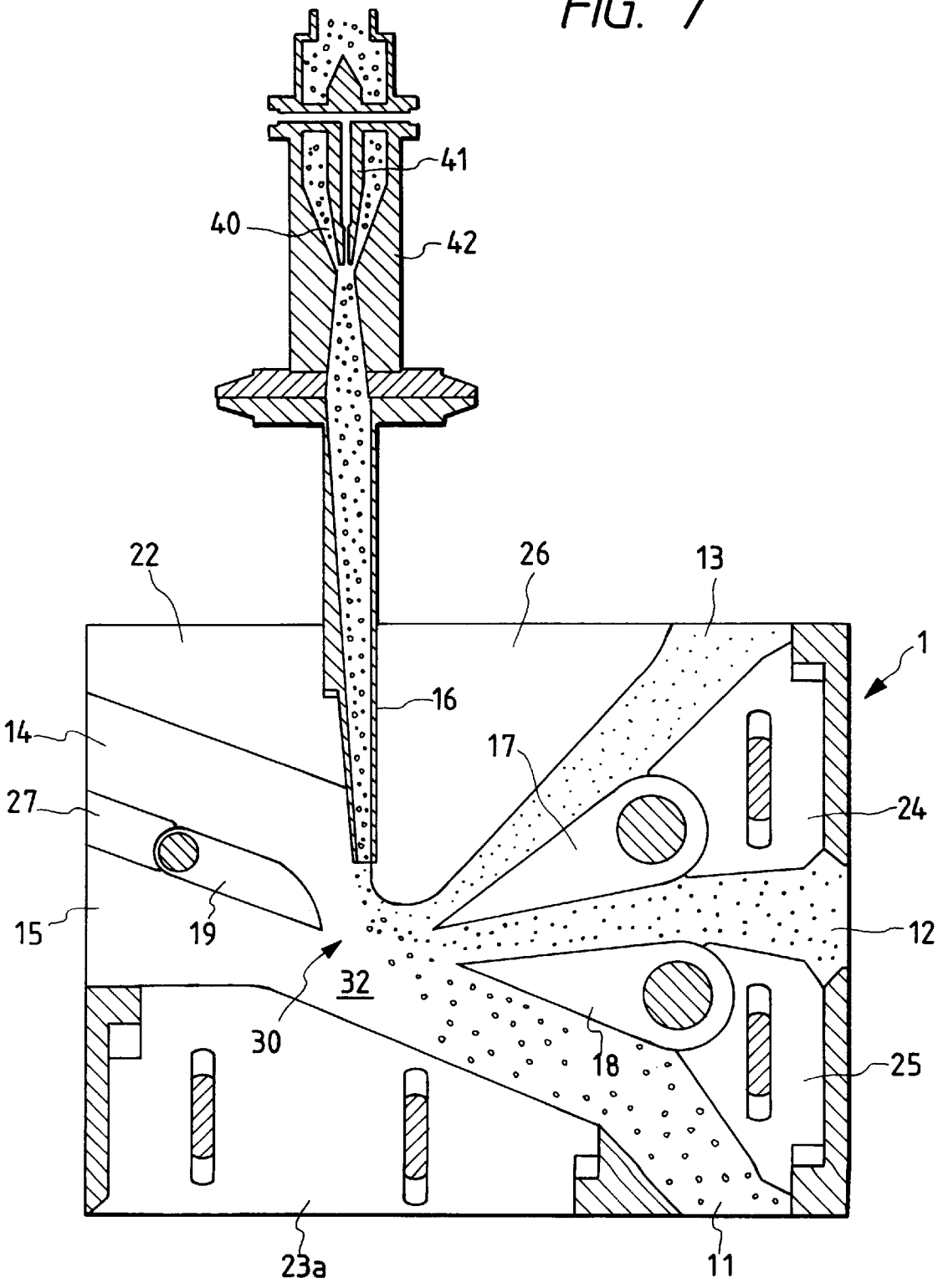
FIG. 7 is a schematic cross section of a gas stream classifier according to another embodiment of the present invention.

In the gas stream classifier shown in FIG. 7, a feed supply opening 40, a feed powder intake nozzle 42 and a high-pressure air supply nozzle 41 are provided at the top of the gas stream classifier, and also the classifying edge blocks having the classifying edges are so designed that their positions can be changed so that the form of the classification zone can be changed. Hence, the upper stream and lower stream can be prevented from occurring. Moreover, the side-wall block 23*a* is so designed that its position can be changed so that the form of the coarse powder suction inlet can be changed. Hence, the relationship shown below can be better maintained, which is a suction balance for enabling classification at a high efficiency without enlarging attached facilities.

$$4.5\times10^{-2}<(Qf\cdot Lm)/(Qm\cdot Lf)<16$$

$$8.2\times10^{-2}<(Qm\cdot Lg)/(Qg\cdot Lm)<40$$

$$10\ \text{m/sec}<Qg/(Lg\cdot Lw)<350\ \text{m/sec}$$

where Qg represents a coarse powder fraction suction flow rate, Qm represents a median powder fraction suction flow rate, Qf represents a fine powder fraction suction flow rate, Lg represents a coarse powder fraction suction edge width, Lm represents a median powder fraction suction edge width, Lf represents a fine powder fraction suction edge width, and Lw represents a classifier width.

Still another preferred gas stream classifier will be described below with reference to FIGS. 10 and 11.

Figure 10:
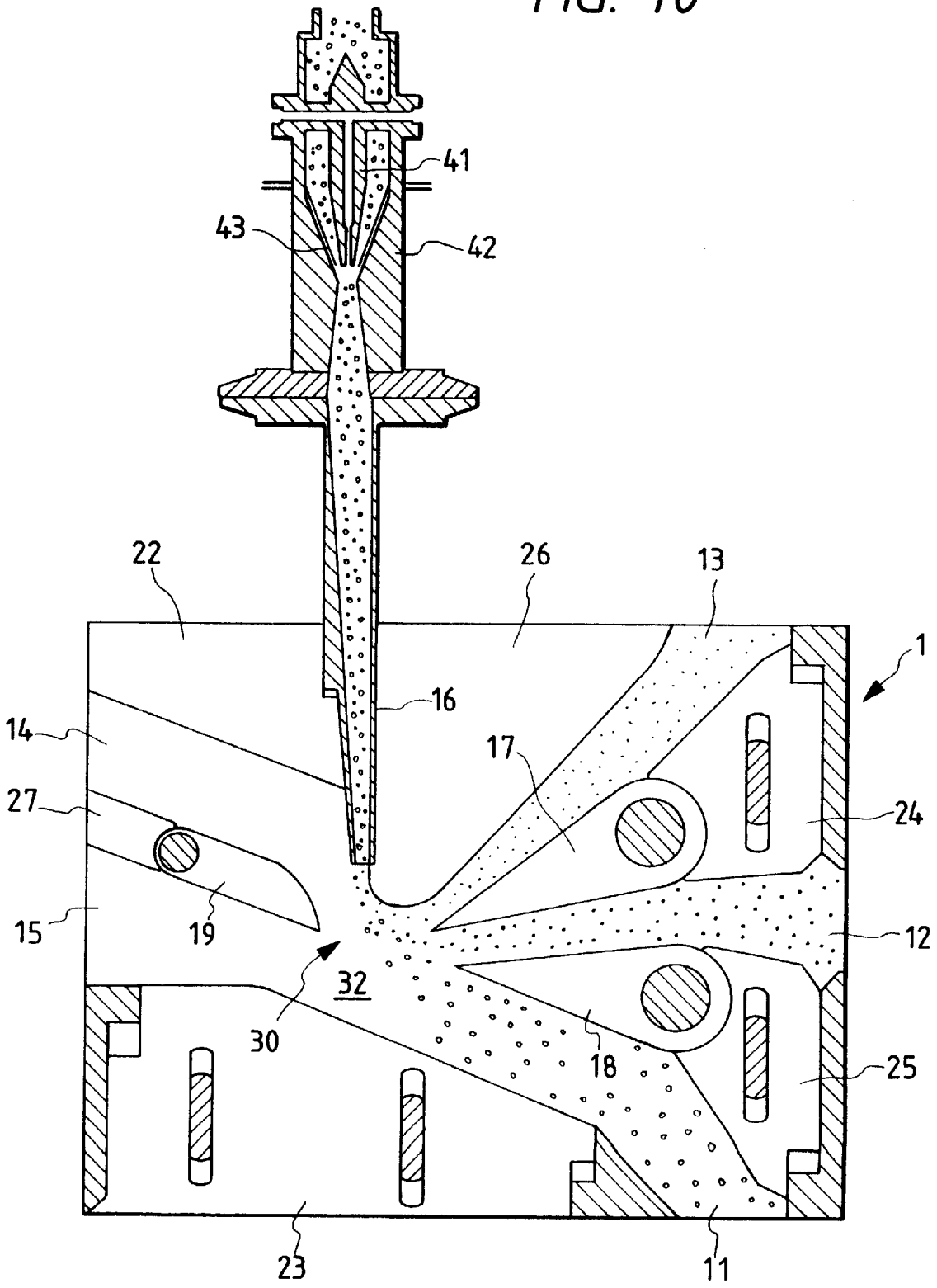
FIG. 10 is a schematic cross section of a gas stream classifier according to still another embodiment of the present invention.

In the gas stream classifier shown in FIG. 10, a means for causing an action of rectification inside the feed supply nozzle is provided to make it possible to decrease turbulent flows in the nozzle. Hence, the impact force and frictional force acting between the wall surface of the feed supply nozzle and the feed powder can be decreased, so that the melt-adhesion in the classifier may not occur, making it possible to drive the classifier in an always stable state and to obtain good-quality classified products over a long period of time.

A secondary air intake path 43 for causing the rectification action and jetting out secondary air in a curtain state to decrease the melt-adhesion of particles in the classifier is formed on the inner wall of the feed powder intake nozzle 42.

Still another preferred gas stream classifier will be described below with reference to FIGS. 12, 13 and 14.

Figure 12:
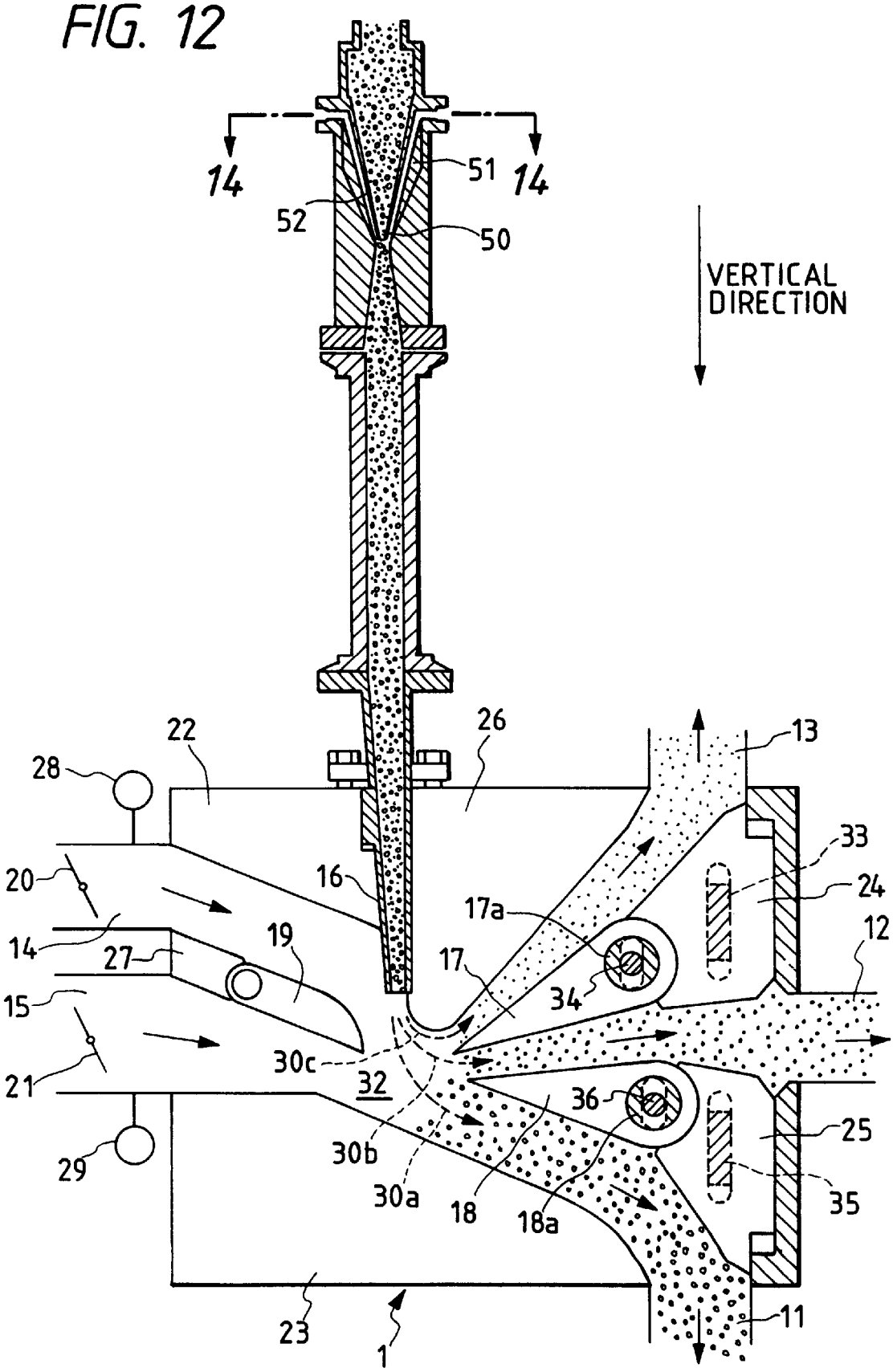
FIG. 12 is a schematic cross section of a gas stream classifier according to a further embodiment of the present invention.

In the gas stream classifier shown in FIG. 12, a feed supply nozzle 16 is provided at the top of a gas stream classifier 1; a Coanda block 26 is provided on one side of the feed supply nozzle 16; and the feed supply nozzle 16 has at its rear end a feed powder intake pipe 52 for supplying the feed powder and a high-pressure air intake pipe 51 provided along the periphery of the feed powder intake pipe 52.

The feed powder is supplied from the top end of the feed powder intake pipe 52. The feed powder thus supplied is emitted or ejected from the lower part of the feed powder intake pipe 52, and is accelerated by the aid of high-pressure air jetted out of the high-pressure air intake pipe 51 so as to be well dispersed. The feed powder is instantaneously introduced into the classifying chamber from the feed supply nozzle 16, and classified there.

The present invention will be described below in greater detail by giving Examples and Comparative Examples.

EXAMPLE 1

| | |
|---|---|
| Binder resin (styrene/butyl acrylate/divinylbenzene copolymer; monomer polymerization weight ratio; 80.0/19.0/1.0; weight average molecular weight Mw: 350,000) | 100 parts |
| Colorant (magnetic iron oxide; average particle diameter: 0.18 μm) | 100 parts |
| Charge control agent (Nigrosine) | 2 parts |
| Release agent (low-molecular weight ethylene/propylene copolymer) | 4 parts |

(all by weight)

The above materials were thoroughly mixed using a Henschel mixer (FM-75 Type, manufactured by Mitsui Miike Engineering Corporation), and then kneaded using a twin-screw kneader (PCM-30 Type, manufactured by Ikegai Corp.) set to a temperature of 150° C. The kneaded product obtained was cooled, and then crushed by means of a hammer mill to a size of 1 mm or less, obtaining a crushed product. The crushed product was pulverized using an impact type air pulverizer to produce a feed powder having a weight average particle diameter of 6.7 μm. The resulting feed powder had a true density of 1.73 g/cm$^3$.

In the classification system as shown in FIG. 6, the feed powder thus obtained was introduced into the multi-division classifier 1 shown in FIGS. 1 to 4, through the feeder 2 and also through the vibrating feeder 3 and the feed supply nozzle 16 (provided substantially vertically and having a feed powder intake nozzle 42, a high-pressure air intake pipe 41 and a deformed cylindrical portion 43), in order to classify the feed powder into the three fractions, coarse powder fraction, median powder fraction and fine powder fraction, at a rate of 35.4 kg/hr by utilizing the Coanda effect.

The feed powder was introduced by utilizing the suction force derived from evacuation of the inside of the system by suction evacuation through the collecting cyclones 4, 5 and 6 communicating with the discharge outlets 11, 12 and 13, respectively, and utilizing the compressed air fed through the injection air intake path 31 of the high-pressure air intake pipe 41 attached to the feed supply nozzle 16.

The form of the classification zone was adjusted and the respective location distances were set as shown below, carrying out classification.

$L_0$: 6 mm (the diameter of the feed supply nozzle discharge orifice 16*a*)

$L_1$: 34 mm (the distance between the sides, facing each other, of the classifying edge 17 and the Coanda block 26)

$L_2$: 33 mm (the distance between the sides, facing each other, of the classifying edge 17 and the classifying edge 18)

$L_3$: 37 mm (the distance between the sides, facing each other, of the classifying edge 18 and the surface of the sidewall 23)

$L_4$: 15 mm (the distance between the tip of the classifying edge 17 and the side of the Coanda block 26)

$L_5$: 33 mm (the distance between the tip of the classifying edge 18 and the side of the Coanda block 26)

$L_6$: 25 mm (the distance between the tip of the air-intake edge 19 and the side of the Coanda block 26)

R: 14 mm (the radius of the arc of the Coanda block 26)

The feed powder thus introduced was instantaneously classified in 0.1 second or less. The median powder fraction obtained by classification had a sharp particle size distribution with a weight average particle diameter of 6.9 μm, containing 22% by number of particles with particle diameters of 4.0 μm or smaller and containing 1.0% by volume of particles with particle diameters of 10.08 μm or larger. The median powder fraction was obtained in a classification yield (the percentage of the finally obtained median powder fraction to the total weight of the feed powder fed) of 92.5%, having a good performance as toner particles.

The coarse powder fraction obtained by classification was again circulated to the step of pulverization.

The true density of the feed powder was measured using Micrometrix Acupic 1330 (manufactured by Shimadzu Corporation) as a measuring device, and 5 g of the colored resin powder was weighed to determine its true density.

The particle size distribution of the toner can be measured by various methods. In the present invention, it was measured using the following measureing device.

A Coulter Counter TA-II or Coulter Multisizer II (manufactured by Coulter Electronics, Inc.) was used as a measuring device. As an electrolytic solution, an aqueous 1% NaCl solution was prepared using first-grade sodium chloride. For example, ISOTON-II (trade name; available from Coulter Scientific Japan Co.) can be used. Measurement was carried out by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample had been suspended was subjected to dispersing treatment for about 1 minute to about 3 minutes with an ultrasonic dispersion machine. The volume and number of toner particles were measured by means of the above measuring device, using an aperture of 100 μm as its aperture to calculate the volume distribution and number distribution of the toner particles. Then, weight-based weight average particle diameter obtained from the volume distribution was determined.

EXAMPLES 2 TO 4

Using the feed powders as shown in Table 1, prepared in the same manner as in Example 1, classification was carried out in the same manner as in Example 1 except that the classification zone was set under conditions as shown in Table 1.

As shown in Tables 2 and 3, median powder fractions all having a sharp particle size distribution were obtainable in a good efficiency. The median powder fractions thus obtained had good performances as toner particles.

TABLE 1

| Example: | Feed powder (1) (μm) | (2) (g/cm$^3$) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 1 | 6.7 | 1.73 | 35.0 | 6 | 34 | 33 | 37 | 15 | 35 | 25 | 14 |
| 2 | 6.3 | 1.73 | 31.0 | 6 | 34 | 32 | 38 | 13 | 33 | 25 | 14 |
| 3 | 5.2 | 1.73 | 25.0 | 6 | 30 | 34 | 39 | 14 | 32 | 25 | 14 |
| 4 | 5.2 | 1.73 | 25.0 | 6 | 34 | 30 | 39 | 16 | 33 | 25 | 14 |

(1): Weight average particle diameter
(2): True density
(3): Rate of feed into classifier

TABLE 2

| Example: | Weight average particle diameter (μm) | Median powder fraction Particle size distribution Particles with particle diameters of: 4.00 μm or smaller (% by number) | 10.08 μm or larger (% by volume) | Classification yield (%) |
|---|---|---|---|---|
| 1 | 6.85 | 22 | 1.0 | 92.5 |
| 2 | 5.9 | 25 | 0.2 | 89 |

TABLE 3

| Example: | Weight average particle diameter (μm) | Median powder fraction Particle size distribution Particles with particle diameters of: 3.17 μm or smaller (% by number) | 8.00 μm or larger (% by volume) | Classification yield (%) |
|---|---|---|---|---|
| 3 | 5.4 | 20 | 1.2 | 87 |
| 4 | 5.4 | 20 | 1.9 | 89 |

EXAMPLES 5 & 6

| | |
|---|---|
| Binder resin (unsaturated polyester resin) | 100 parts |
| Colorant (copper phthalocyanine pigment; C.I. Pigment Blue 15) | 4.5 parts |
| Charge control agent (metal compound of dialkylsalicylic acid) | 4.0 parts (all by weight) |

The above materials were thoroughly mixed using a Henschel mixer (FM-75 Type, manufactured by Mitsui Miike Engineering Corporation), and then kneaded using a twin-screw kneader (PCM-30 Type, manufactured by Ikegai Corp.) set to a temperature of 100° C. The kneaded product obtained was cooled, and then crushed by means of a hammer mill to a size of 1 mm or less, obtaining a crushed product for toner production. The crushed product was pulverized using an impact type air pulverizer to produce a feed powder having a weight average particle diameter of 6.5 μm (Example 5) and a feed powder having a weight average particle diameter of 5.5 μm (Example 6). The resulting feed powders had a true density of 1.08 g/cm$^3$.

Using the feed powders, classification was carried out in the same manner as in Example 1 except that the classification conditions were set as shown in Table 4.

As shown in Tables 5 and 6, median powder fractions all having a sharp particle size distribution were obtained in a good efficiency. The median powder fractions thus obtained had good performances as toner particles.

TABLE 4

| Example: | Feed powder (1) (μm) | (2) (g/cm$^3$) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 5 | 6.1 | 1.08 | 31.0 | 6 | 25 | 20 | 35 | 16 | 30 | 25 | 8 |
| 6 | 5.7 | 1.08 | 24.0 | 9 | 24 | 19 | 39 | 16 | 29 | 25 | 8 |

(1): Weight average particle diameter
(2): True density
(3): Rate of feed into classifier

TABLE 5

| Example: | Weight average particle diameter (μm) | Median powder fraction Particle size distribution Particles with particle diameters of: 4.00 μm or smaller (% by number) | 10.08 μm or larger (% by volume) | Classification yield (%) |
|---|---|---|---|---|
| 5 | 5.8 | 21 | 1.0 | 82 |

TABLE 6

| Example: | Weight average particle diameter (μm) | Median powder fraction Particle size distribution Particles with particle diameters of: 3.17 μm or smaller (% by number) | 8.00 μm or larger (% by volume) | Classification yield (%) |
|---|---|---|---|---|
| 6 | 5.75 | 10.2 | 1.8 | 81 |

Comparative Examples 1 to 3

Using the same starting materials as used in Example 1, the crushed product was pulverized using the impact type air pulverizer to produce a feed powder having a weight average particle diameter of 6.9 μm (Comparative Example 1) and a feed powder having a weight average particle diameter of 5.5 μm (Comparative Example 2).

The starting materials were replaced with those as used in Example 5 to produce a feed powder having a weight average particle diameter of 6.0 μm (Comparative Example 3).

Figure 18:
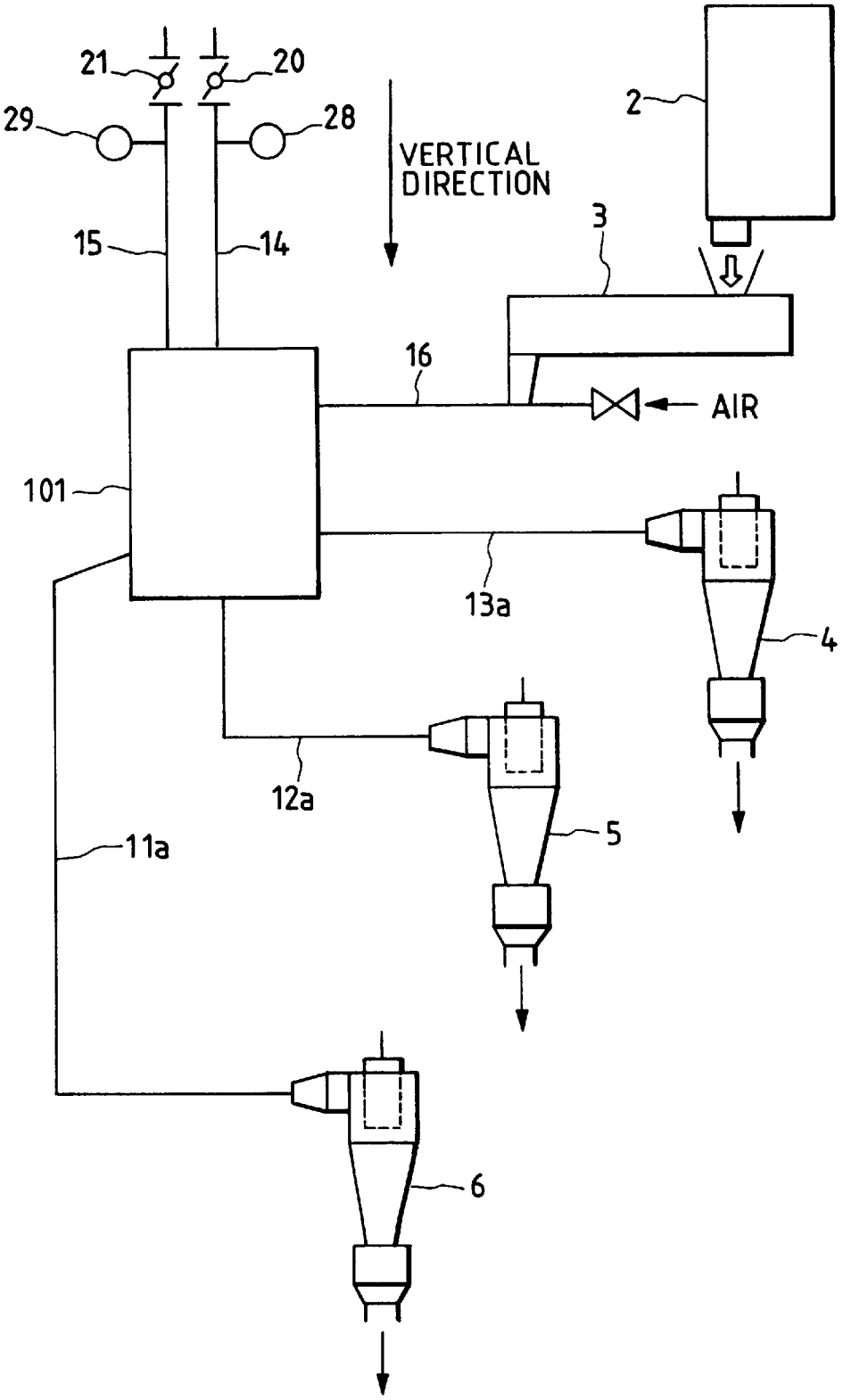
FIG. 18 PRIOR ART
FIG. 18 illustrates an example of a conventional classification process.

Those feed powders were each classified according to the flow chart as shown in FIG. 18, using the multi-division classifier as shown in FIGS. 15, 16 and 17. The feed supply nozzle 16 was set at an angle of about 90 degrees with respect to the vertical direction.

The classification of each powder was carried out under conditions as shown in Table 7, and the data of the median powder fractions obtained by the classification were as shown in Tables 8 to 10.

TABLE 7

| Comparative Example: | Feed powder (1) (μm) | (2) (g/cm³) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 1 | 6.9 | 1.73 | 30.0 | 6 | 30 | 25 | 55 | 17.5 | 28 | 25 | 14 |
| 2 | 5.5 | 1.73 | 25.0 | 6 | 30 | 25 | 55 | 14.5 | 29 | 25 | 14 |
| 3 | 6.0 | 1.08 | 31.0 | 6 | 30 | 25 | 55 | 13 | 25 | 25 | 14 |

(1): Weight average particle diameter
(2): True density
(3): Rate of feed into classifier

TABLE 8

| Comparative Example | Weight average particle diameter (μm) | Median powder fraction Particle size distribution Particles with particle diameters of: 4.00 μm or smaller (% by number) | 10.08 μm or larger (% by volume) | Classification yield (%) |
|---|---|---|---|---|
| 1 | 6.9 | 28 | 2.0 | 70 |

TABLE 9

| Comparative Example | Weight average particle diameter (μm) | Median powder fraction Particle size distribution Particles with particle diameters of: 3.17 μm or smaller (% by number) | 8.00 μm or larger (% by volume) | Classification yield (%) |
|---|---|---|---|---|
| 2 | 5.4 | 41 | 2.0 | 65 |

TABLE 10

| Comparative Example | Weight average particle diameter (μm) | Median powder fraction Particle size distribution Particles with particle diameters of: 4.00 μm or smaller (% by number) | 10.08 μm or larger (% by volume) | Classification yield (%) |
|---|---|---|---|---|
| 3 | 5.9 | 34 | 2.8 | 68 |

EXAMPLE 7

The procedure of Example 1 was repeated to produce a feed powder with a weight average particle diameter of 6.7 μm.

Figure 8:
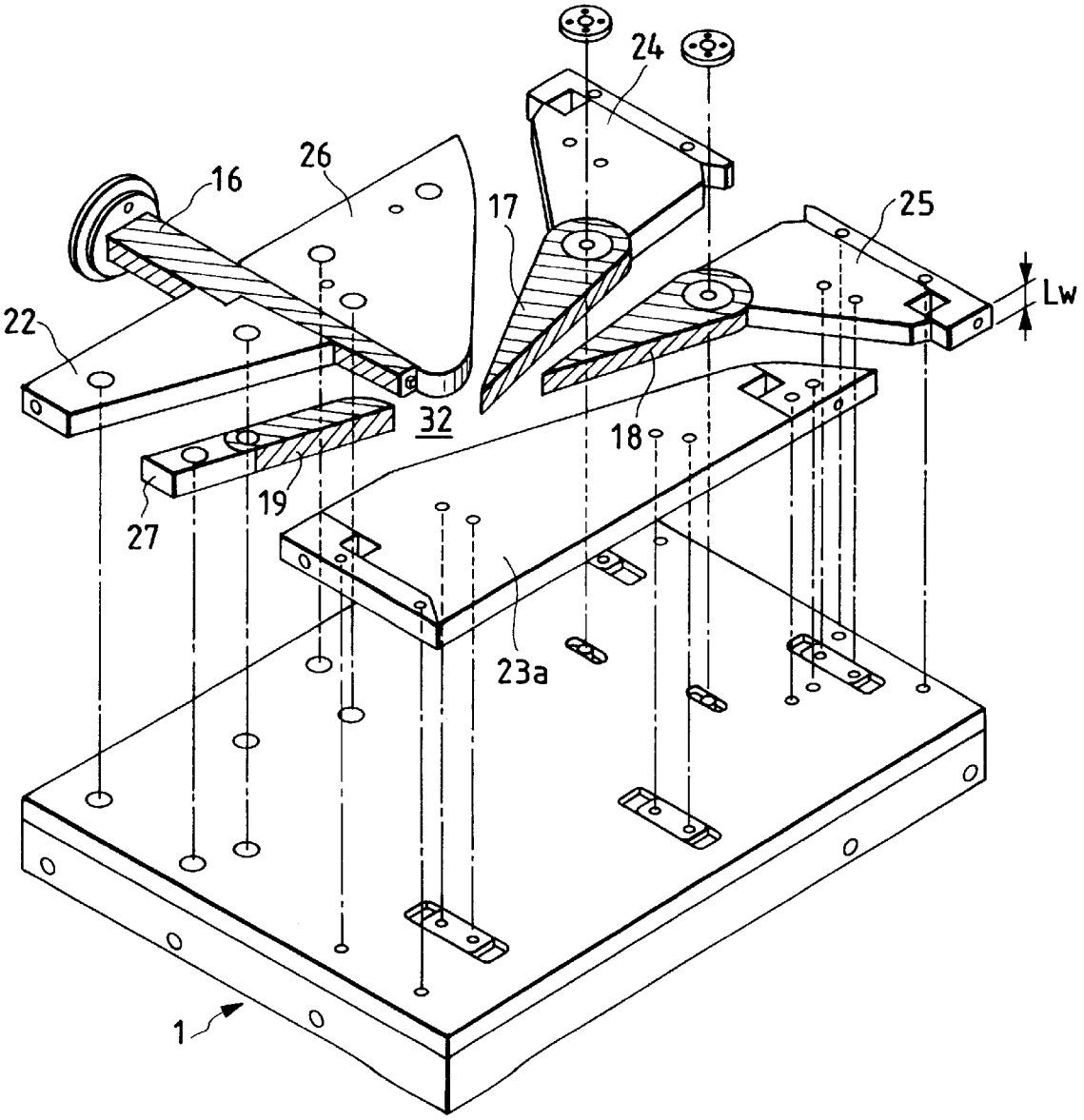
FIG. 8 is an exploded perspective view of the classifying part of the gas stream classifier shown in FIG. 7.
Figure 9:
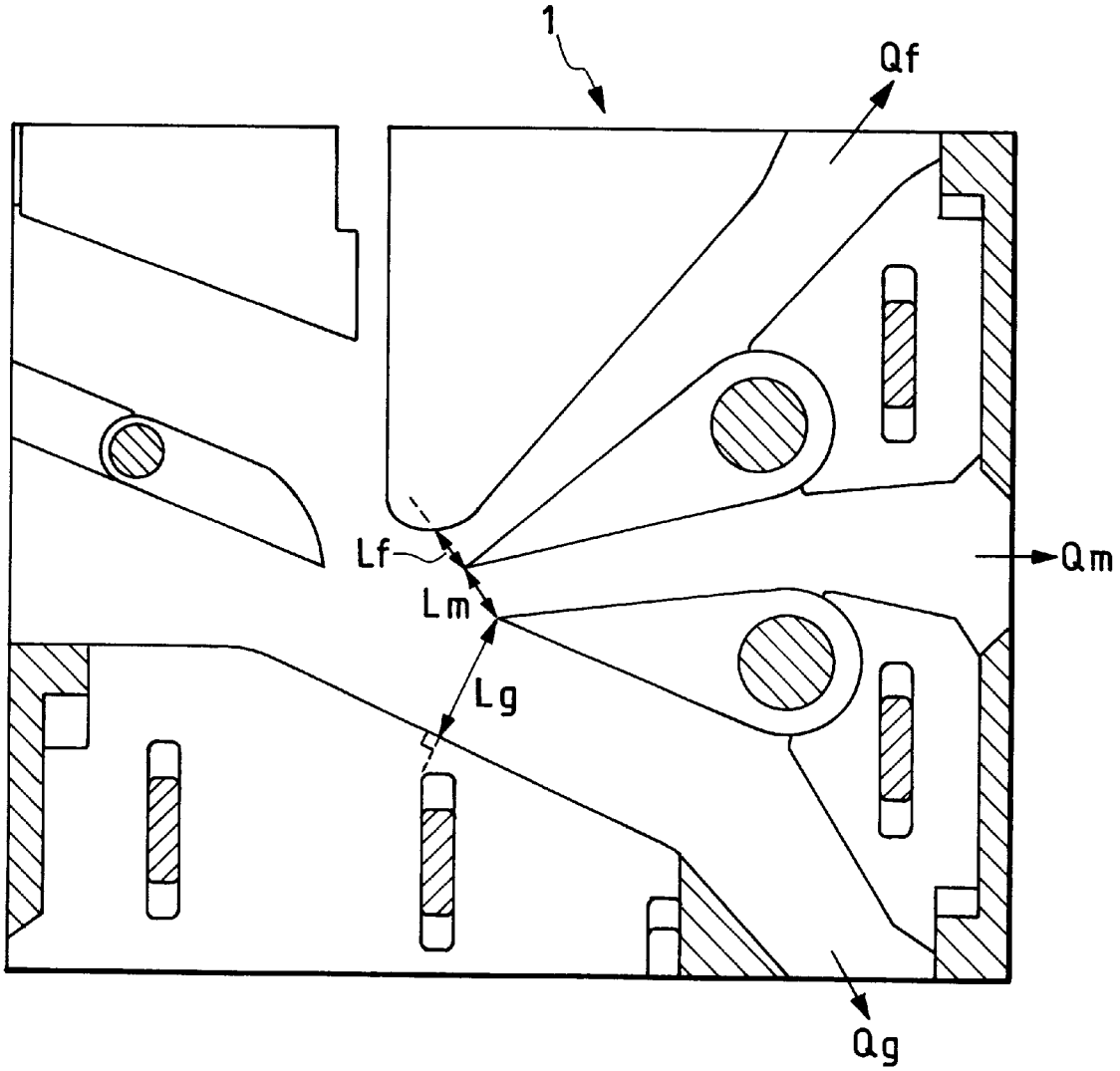
FIG. 9 illustrates a classifying chamber of the gas stream classifier shown in FIG. 7.

In the classification system as shown in FIG. 6, the feed powder thus produced was introduced into the multi-division classifier 1 shown in FIGS. 7, 8 and 9, through the feeder 2 and also through the vibrating feeder 3 and the feed supply nozzle 16, in order to classify the feed powder into the three fractions, coarse powder fraction, median powder fraction and fine powder fraction, at a rate of 35.0 kg/hr by utilizing the Coanda effect.

The feed powder was introduced by utilizing the suction force derived from evacuation of the inside of the system by suction evacuation through the collecting cyclones 4, 5 and 6 communicating with the discharge outlets 11, 12 and 13, respectively, and utilizing the compressed air fed from the high-pressure air nozzle 41 attached to the feed powder intake nozzle 42. The feed powder thus introduced was instantaneously classified in 0.1 seconds or less. In this classification, the values of (Qf·Lm)/(Qm·Lf), (Qm·Lg)/(Qg·Lm), and Qg/(Lg·Lw) were 1.3, 1.7, and 30 m/sec, respectively. The median powder fraction obtained by classification had a weight average particle diameter of 6.9 μm, containing 22% by number of particles with particle diameters of 4.0 μm or smaller and containing 1.0% by volume of particles with particle diameters of 10.08 μm or larger, and was in a classification yield (the percentage of the finally obtained median powder fraction with respect to the total weight of the feed powder fed) of 93%. The median powder fraction obtained had a good performance as toner particles.

EXAMPLES 8 TO 10

Using the feed powders as shown in Table 11, which were prepared in the same manner as in Example 7, classification was carried out in the same manner as in Example 7 except that the locations of the classifying edge blocks 24 and 25 and sidewall block 23*a* were changed, and under conditions as shown in Tables 11 and 12.

As the result, as shown in Table 11, median powder fractions having a sharp particle size distribution were obtained in a good efficiency. The median powder fractions thus obtained had good performances as toner particles.

TABLE 11

| Example: | Feed powder Supply quantity (kg/h) | Av. particle diam. (μm) | Av. particle diam. (μm) | Median powder fraction Particles with particle diameters of: 4.00 μm or smaller (num. %) | 10.08 μm or larger (vol. %) | Yield (%) |
|---|---|---|---|---|---|---|
| 7 | 35.0 | 6.7 | 6.9 | 22 | 1.0 | 93 |
| 8 | " | " | 7.1 | 15 | 2.0 | 84 |
| 9 | 31.0 | 5.5 | 5.8 | 35 | 0.1 | 80 |
| 10 | " | " | 6.0 | 30 | 0.1 | 77 |

TABLE 12

| Example | (Qf · Lm)/(Qm · Lf) | (Qm · Lg)/(Qg · Lm) | Qg/(Lg · Lw) (m/sec) |
|---|---|---|---|
| 7 | 1.3 | 1.7 | 30 |
| 8 | 1.5 | 1.7 | 35 |
| 9 | 1.0 | 1.9 | 40 |
| 10 | 1.2 | 1.9 | 50 |

EXAMPLES 11 & 12

The procedure of Example 5 was repeated to produce a feed powder with a weight average particle diameter of 6.4 μm (Example 11).

In the same manner as in Example 7, the feed powder thus produced was classified into the three fractions, coarse powder fraction, median powder fraction and fine powder fraction, through the feeder 2 and also through the vibrating feeder 3 and the feed supply nozzle 16 at a rate of 26.0 kg/hr by utilizing the Coanda effect.

The feed powder was introduced by utilizing the suction force derived from evacuation of the inside of the system by suction evacuation through the collecting cyclones 4, 5 and 6 communicating with the discharge outlets 11, 12 and 13, respectively, and utilizing the compressed air fed from the high-pressure air nozzle 41 attached to the feed powder intake nozzle 42. In this classification, the values of (Qf·Lm)/(Qm·Lf), (Qm·Lg)/(Qg·Lm), and Qg/(Lg·Lw) were 2.5, 3.1, and 45 m/sec, respectively. The median powder fraction obtained by classification had a weight average particle diameter of 5.6 μm, containing 38% by number of particles with particle diameters of 4.0 μm or smaller and containing 0.1% by volume of particles with particle diameters of 10.08 μm or larger, and was in a classification yield (the percentage of the finally obtained median powder fraction with respect to the total weight of the feed powder fed) of 76%. The median powder fraction obtained had a good performance as toner particles.

Using the above feed powder, classification was carried out in the same manner as in Example 11 except that the locations of the classifying edge blocks 24 and 25 and sidewall block 23*a* were changed. In this classification, the values of (Qf·Lm)/(Qm·Lf), (Qm·Lg)/(Qg·Lm), and Qg/(Lg·Lw) were 2.0, 2.7, and 50 m/sec, respectively (Example 12). As the result, the median powder fraction obtained by classification had a weight average particle diameter of 5.9 μm, containing 35% by number of particles with particle diameters of 4.00 μm or smaller and containing 0.1% by volume of particles with particle diameters of 10.08 μm or larger, and was in a classification yield (the percentage of the finally obtained median powder fraction with respect to the total weight of the feed powder fed) of 74%. The median powder fraction obtained had a good performance as toner particles.

EXAMPLE 13

The procedure of Example 1 was repeated to produce a feed powder with a weight average particle diameter of 6.7 μm.

Figure 11:
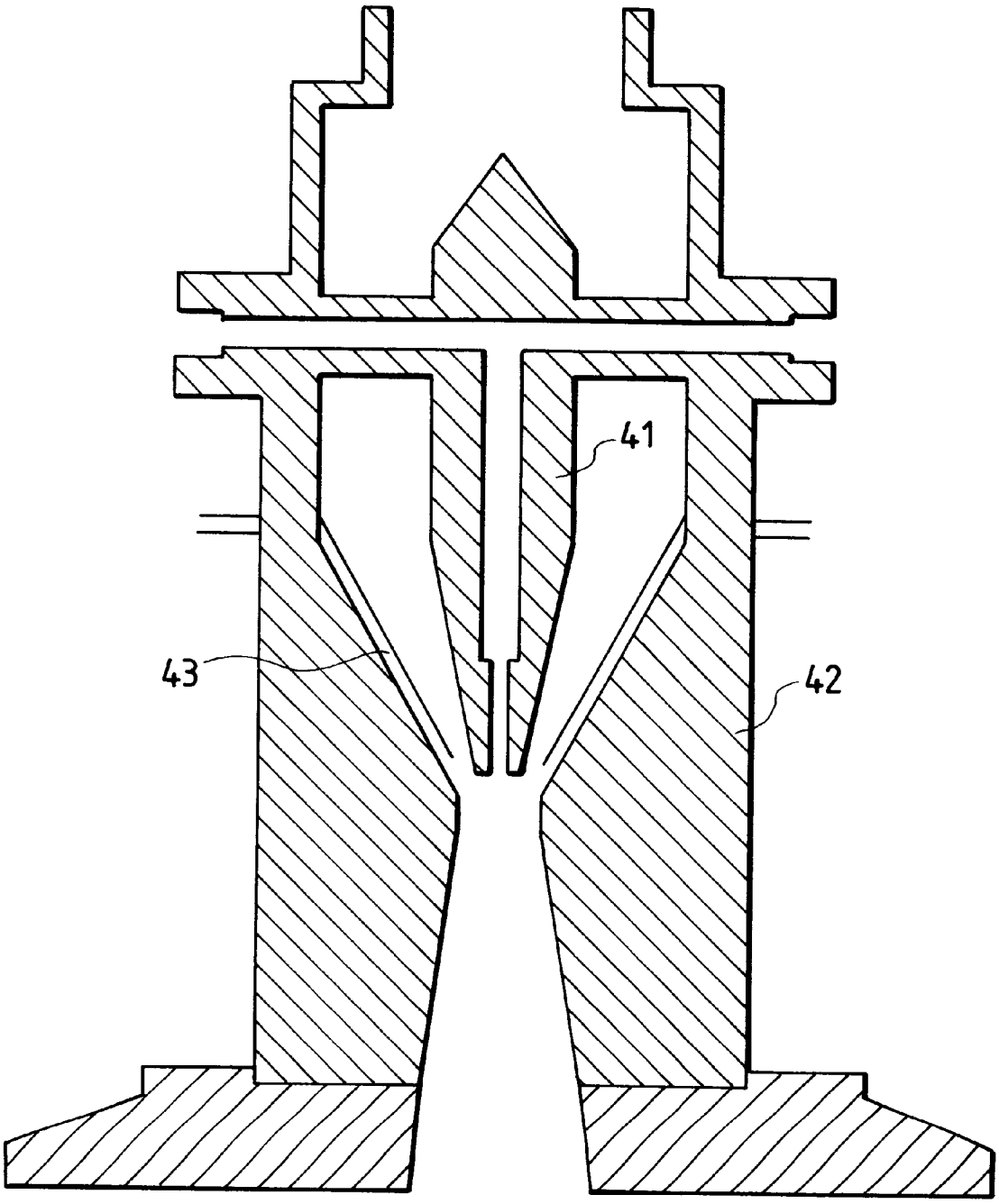
FIG. 11 is an enlarged view of a high-pressure air supply nozzle and the vicinity thereof, shown in FIG. 10.

In the classification system as shown in FIG. 6, the feed powder thus produced was introduced into the multi-division classifier 1 shown in FIGS. 10 and 11, through the feeder 2 and also through the vibrating feeder 3 and the feed supply nozzle 16, in order to classify the feed powder into the three fractions, coarse powder fraction, median powder fraction and fine powder fraction, at a rate of 35.0 kg/hr by utilizing the Coanda effect.

The feed powder was introduced by utilizing the suction force derived from evacuation of the inside of the system by suction evacuation through the collecting cyclones 4, 5 and 6 communicating with the discharge outlets 11, 12 and 13, respectively, and utilizing the compressed air fed from the high-pressure air nozzle 41 attached to the feed powder intake nozzle 42. Compressed air was further introduced through the secondary air intake path 43 for the purpose of rectification in the inner wall of the feed powder intake nozzle 42. The feed powder thus introduced was instantaneously classified in 0.1 second or less. The median powder fraction obtained by classification had a weight average particle diameter of 6.9 μm, containing 22% by number of particles with particle diameters of 4.00 μm or smaller and containing 1.0% by volume of particles with particle diameters of 10.08 μm or larger, and was in a classification yield (the percentage of the finally obtained median powder fraction with respect to the total weight of the feed powder fed) of 93%. The median powder fraction obtained had a good performance as toner particles.

In the gas stream classifier shown in FIG. 10, melt-adhesion to the inner walls of the feed powder intake nozzle and feed supply nozzle was prevented well.

EXAMPLES 14 TO 16

Using the feed powders as shown in Table 13, which were prepared in the same manner as in Example 13, classification was carried out in the same manner as in Example 13 except that the locations of the tip positions of the classifying edges and the classifying edge blocks 24 and 25 were changed, and under conditions as shown in Table 13.

As the result, as shown in Table 13, median powder fractions having a sharp particle size distribution were obtained in a good efficiency. The median powder fractions thus obtained had good performances as toner particles.

In these Examples, melt-adhesion to the inner walls of the feed powder intake nozzle and feed supply nozzle were well prevented well.

TABLE 13

| | Feed powder | | Median powder fraction | | | |
|---|---|---|---|---|---|---|
| | | | | Particles with particle diameters of: | | |
| Example: | Supply quantity (kg/h) | Av. particle diam. (μm) | Av. particle diam. (μm) | 4.00 μm or smaller (num. %) | 10.08 μm or larger (vol. %) | Yield (%) |
| 13 | 35.0 | 6.7 | 6.9 | 22 | 1.0 | 93 |
| 14 | " | " | 7.1 | 15 | 2.0 | 84 |
| 15 | 31.0 | 5.5 | 5.8 | 35 | 0.1 | 80 |
| 16 | " | " | 6.0 | 30 | 0.1 | 77 |

EXAMPLES 17 & 18

The procedure of Example 5 was repeated to produce a feed powder with a weight average particle diameter of 6.4 μm (Example 17).

In the same manner as in Example 13, through the feeder 2 and also through the vibrating feeder 3 and the feed supply nozzle 16, the feed powder thus produced was classified into the three fractions, coarse powder fraction, median powder fraction and fine powder fraction, at a rate of 26.0 kg/hr by utilizing the Coanda effect.

The feed powder was introduced by utilizing the suction force derived from evacuation of the inside of the system by suction evacuation through the collecting cyclones 4, 5 and 6 communicating with the discharge outlets 11, 12 and 13, respectively, and utilizing the compressed air fed from the high-pressure air nozzle 41 attached to the feed powder intake nozzle 42. Compressed air was further introduced through the secondary air intake path 43 for the purpose of rectification in the inner wall of the feed powder intake nozzle 42. The median powder fraction obtained by classification had a weight average particle diameter of 5.6 μm, containing 38% by number of particles with particle diameters of 4.00 μm or smaller and containing 0.1% by volume of particles with particle diameters of 10.08 μm or larger, and was in a classification yield (the percentage of the finally obtained median powder fraction with respect to the total weight of the feed powder fed) of 76%. The median powder fraction obtained had a good performance as toner particles. Melt-adhesion to the inner walls of the feed powder intake nozzle and feed supply nozzle were prevented well.

Using the above feed powder, classification was carried out under the same conditions and the same system as in Example 17 except that the locations of the tip positions of the classifying edges and the classifying edge blocks were changed (Example 18). As the result, the median powder fraction obtained by classification had a weight average particle diameter of 5.9 μm, containing 35% by number of particles with particle diameters of 4.00 μm or smaller and containing 0.1% by volume of particles with particle diameters of 10.08 μm or larger, and was in a classification yield (the percentage of the finally obtained median powder fraction with respect to the total weight of the feed powder fed) of 74%. The median powder fraction obtained had a good performance as toner particles.

EXAMPLE 19

The procedure of Example 1 was repeated to produce a feed powder with a weight average particle diameter of 6.7 μm. The feed powder produced had a true density of 1.73 g/cm$^3$.

Figure 13:
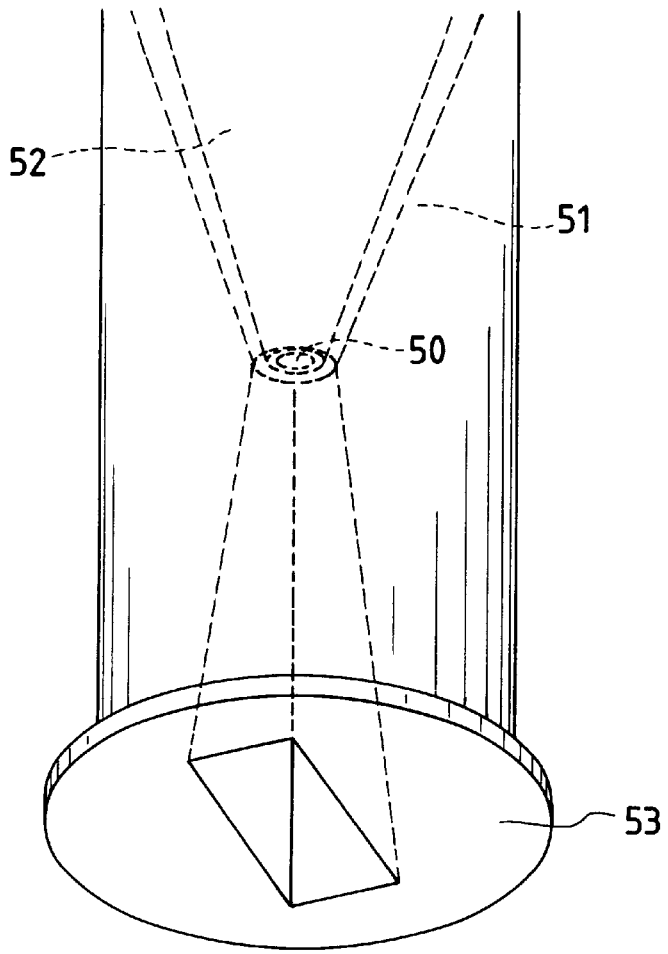
FIG. 13 illustrates a feed powder supply portion and the vicinity thereof, of the gas stream classifier shown in FIG. 12.
Figure 14:
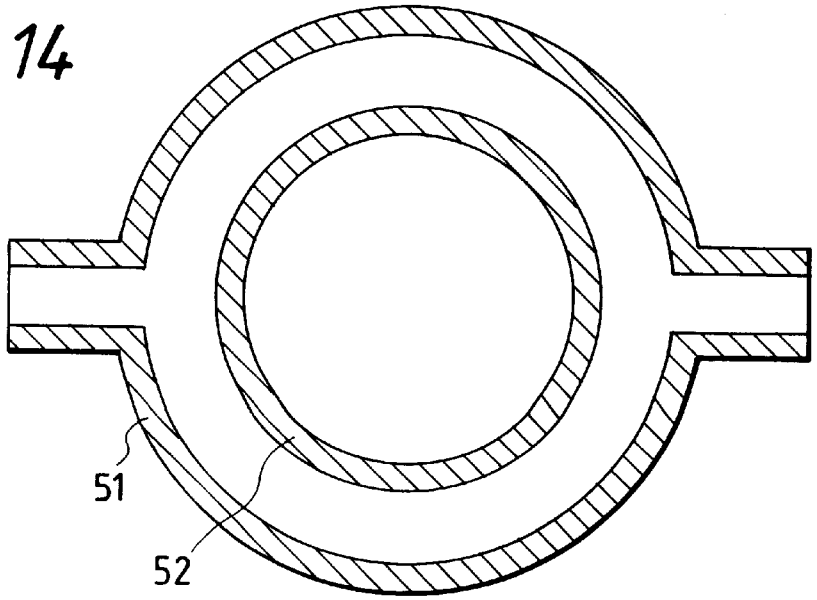
FIG. 14 is a cross section along the line 14—14 of the classifier shown in FIG. 12.

In the classification system as shown in FIG. 6, the feed powder thus produced was introduced into the multi-division classifier 1 shown in FIGS. 12, 13 and 14, through the feeder 2 and also through the vibrating feeder 3 and the feed supply nozzle 16 (having a feed powder intake pipe 52, a high-pressure air intake portion 51 and a deformed cylindrical portion 53), in order to classify the feed powder into the three fractions, coarse powder fraction, median powder fraction and fine powder fraction, at a rate of 35.0 kg/hr by utilizing the Coanda effect.

The feed powder was introduced by utilizing the suction force derived from evacuation of the inside of the system by suction evacuation through the collecting cyclones 4, 5 and 6 communicating with the discharge outlets 11, 12 and 13, respectively, and utilizing the compressed air fed from the high-pressure air intake 51 attached to the feed supply nozzle 16.

The form of the classification zone was adjusted and the respective location distances were set as shown below, carrying out classification.

$L_0$: 6 mm (the diameter of the feed supply nozzle discharge orifice 16*a*)

$L_1$: 34 mm (the distance between the sides, facing each other, of the classifying edge 17 and the Coanda block 26)

$L_2$: 33 mm (the distance between the sides, facing each other, of the classifying edge 17 and the classifying edge 18)

$L_3$: 37 mm (the distance between the sides, facing each other, of the classifying edge 18 and the surface of the sidewall 23)

$L_4$: 16 mm (the distance between the tip of the classifying edge 17 and the side of the Coanda block 26)

$L_5$: 34 mm (the distance between the tip of the classifying edge 18 and the side of the Coanda block 26)

$L_6$: 25 mm (the distance between the tip of the air-intake edge 19 and the side of the Coanda block 26)

R: 14 mm (the radius of the arc of the Coanda block 26)

The feed powder thus introduced was instantaneously classified in 0.1 seconds or less. The median powder fraction obtained by classification had a sharp particle size distribution with a weight average particle diameter of 6.95 μm, containing 22% by number of particles with particle diameters of 4.0 μm or smaller and containing 1.0% by volume of particles with particle diameters of 10.08 μm or larger. The median powder fraction was obtained in a classification yield (the percentage of the finally obtained median powder fraction with respect to the total weight of the feed powder fed) of 88%. The median powder fraction obtained had a good performance as toner particles. The coarse powder fraction obtained by classification was again circulated to the step of pulverization.

EXAMPLES 20 TO 22

Using the feed powders as shown in Table 14, which were prepared in the same manner as in Example 19, classification was carried out using the same apparatus system as in Example 19 except that that the classification zone was set at location distances as shown in Table 14.

As shown in Tables 15 and 16, median powder fractions having a sharp particle size distribution were obtained in a good efficiency. The median powder fractions thus obtained had good performances as toner particles.

TABLE 14

| Example: | Feed powder (1) (μm) | (2) (g/cm$^3$) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 19 | 6.7 | 1.73 | 35.0 | 6 | 34 | 33 | 37 | 16 | 34 | 25 | 14 |
| 20 | 6.3 | 1.73 | 31.0 | 6 | 34 | 32 | 38 | 15 | 32 | 25 | 14 |
| 21 | 5.2 | 1.73 | 25.0 | 6 | 30 | 34 | 39 | 14 | 31 | 25 | 14 |
| 22 | 5.2 | 1.73 | 25.0 | 6 | 34 | 30 | 39 | 17 | 32 | 25 | 14 |

(1): Weight average particle diameter
(2): True density
(3): Rate of feed into classifier

TABLE 15

| Example: | weight average particle diameter (μm) | Median powder fraction Particle size distribution Particles with particle diameters of: 4.00 μm or smaller (% by number) | 10.08 μm or larger (% by volume) | Classification yield (%) |
|---|---|---|---|---|
| 19 | 6.95 | 22 | 1.0 | 88 |
| 20 | 5.9 | 25 | 0.2 | 85 |

TABLE 16

| Example: | weight average particle diameter (μm) | Median powder fraction Particle size distribution Particles with particle diameters of: 3.17 μm or smaller (% by number) | 8.00 μm or larger (% by volume) | Classification yield (%) |
|---|---|---|---|---|
| 21 | 5.4 | 20.3 | 1.2 | 82 |
| 22 | 5.4 | 20.1 | 1.9 | 84 |

EXAMPLES 23 & 24

The procedure of Example 5 was repeated to produce a feed powder with a weight average particle diameter of 6.5 μm (Example 23). The feed powder poduced had a true density of 1.08 g/cm$^3$.

Using the feed powder thus produced, classification was carried out using the same apparatus system as in Example 20 except that the classification conditions were set as shown in Table 17.

The same crushed product as used in the above was pulverized using an impact type air pulverizer to produce a feed powder having a weight average particle diameter of 5.5 μm (Example 5), and classification was carried out under classification conditions as shown in Table 17.

As shown in Tables 18 and 19, median powder fractions having a sharp particle size distribution were obtained in a good efficiency. The median powder fractions thus obtained had good performances as toner particles.

TABLE 17

| Example: | Feed powder (1) ($\mu$m) | (2) (g/cm$^3$) | (3) (kg/h) | Location distances (mm) in classification zone $L_0$ | $L_1$ | $L_2$ | $L_3$ | $L_4$ | $L_5$ | $L_6$ | R |
|---|---|---|---|---|---|---|---|---|---|---|---|
| 23 | 6.5 | 1.08 | 31.0 | 6 | 25 | 20 | 35 | 16 | 30 | 25 | 8 |
| 24 | 5.5 | 1.08 | 24.0 | 9 | 24 | 19 | 39 | 16 | 29 | 25 | 8 |

(1): Weight average particle diameter
(2): True density
(3): Rate of feed into classifier

TABLE 18

| Example: | weight average particle diameter ($\mu$m) | Median powder fraction Particle size distribution Particles with particle diameters of: 4.00 $\mu$m or smaller (% by number) | 10.08 $\mu$m or larger (% by volume) | Classification yield (%) |
|---|---|---|---|---|
| 23 | 5.9 | 20.1 | 1.0 | 80 |

TABLE 19

| Example: | weight average particle diameter ($\mu$m) | Median powder fraction Particle size distribution Particles with particle diameters of: 3.17 $\mu$m or smaller (% by number) | 8.00 $\mu$m or larger (% by volume) | Classification yield (%) |
|---|---|---|---|---|
| 24 | 5.7 | 11 | 1.8 | 79 |

What is claimed is:

1. A gas stream classifier comprising a gas stream classifying means for classifying a feed powder supplied from a feed supply nozzle, into at least a coarse powder fraction, a median powder fraction and a fine powder fraction by an inertia force acting on particles and a centrifugal force acting on a curved gas stream due to Coanda effect in a classification zone, wherein:

said classification zone is defined by at least a Coanda block and a plurality of classifying edges; said feed supply nozzle is provided at the top of the gas stream classifier; the Coanda block is provided on one side of said feed supply nozzle; and said feed supply nozzle has at its rear end a high-pressure air intake pipe and a feed powder supply opening at the periphery of said high-pressure air intake pipe.

2. The gas stream classifier according to claim 1, wherein said high-pressure air intake portion of said feed supply nozzle comprises a high-pressure air intake pipe, and said feed powder intake portion for supplying the feed powder comprises a feed powder intake nozzle; said feed powder intake nozzle being so provided as to envelop the periphery of said high-pressure air intake pipe.

3. The gas stream classifier according to claim 2, wherein said feed supply nozzle is provided at an angle of 45° or smaller with respect to the vertical direction.

4. The gas stream classifier according to claim 1, wherein said gas stream classifying means has a coarse powder discharge outlet for discharging the coarse powder fraction formed by classification, and the coarse powder discharge outlet is provided below a fine powder discharge outlet for discharging the fine powder fraction formed by classification.

5. The gas stream classifier according to claim 1, wherein said feed powder intake portion comprises a feed powder intake nozzle, and the feed powder intake nozzle is provided at the center of said high-pressure air intake portion so that an air supply path for supplying high-pressure air is formed between the outer wall of the feed powder intake nozzle and the inner wall of the high-pressure air intake portion.

6. The gas stream classifier according to claim 2, wherein the classifying edges are held by classifying edge blocks, and the classifying edges and the classifying edge blocks can be changed in their locations.

7. The gas stream classifier according to claim 6, wherein said classifying edges are held by said classifying edge blocks, and the tips of the classifying edges are swing-movable.

8. The gas stream classifier according to claim 7, wherein the locations of said classifying edge blocks are changeable in the vertical direction or in the substantially vertical direction.

9. The gas stream classifier according to claim 7, wherein the locations of said classifying edges are changeable in the vertical direction or in the substantially vertical direction.

10. The gas stream classifier according to claim 1, wherein said classification zone is defined by at least said Coanda block, said plurality of classifying edges and a sidewall block; the position of said sidewall block being changeable so that the form of a coarse powder suction opening is changeable.

11. The gas stream classifier according to claim 10, wherein the high-pressure air intake portion of the feed supply nozzle comprises a high-pressure air intake pipe, and the feed powder intake portion for supplying the feed powder comprises a feed powder intake nozzle, said feed powder intake nozzle being so provided as to envelop the periphery of said high-pressure air intake pipe, and said feed supply nozzle, said feed powder intake nozzle and said high-pressure air intake pipe are provided at an angle of 45° or smaller with respect to the vertical direction.

12. The gas stream classifier according to claim 2, wherein said feed powder intake nozzle internally has means for causing rectification action.

13. The gas stream classifier according to claim 12, wherein said feed powder intake nozzle internally has means for introducing secondary air along its inner wall so that the inside of said feed powder intake nozzle is rectified.

14. The gas stream classifier according to claim 12, wherein the feed supply nozzle, the feed powder intake nozzle and the high-pressure air intake pipe are provided at an angle of 45° or smaller with respect to the vertical direction.

15. The gas stream classifier according to claim 1, wherein said feed supply nozzle is provided vertically or substantially vertically.

* * * * *